US009989329B2

(12) United States Patent
Kelly

(10) Patent No.: US 9,989,329 B2
(45) Date of Patent: Jun. 5, 2018

(54) ARCHERY CORD MANAGER

(71) Applicant: Perfect Form Manufacturing LLC, West Henrietta, NY (US)

(72) Inventor: Daniel N. Kelly, Dixon, CA (US)

(73) Assignee: Perfect Form Manufacturing LLC, West Henrietta, NY (US)

( * ) Notice: Subject to any disclaimer, the term of this patent is extended or adjusted under 35 U.S.C. 154(b) by 0 days. days.

(21) Appl. No.: 15/699,243

(22) Filed: Sep. 8, 2017

(65) Prior Publication Data

US 2018/0073830 A1 Mar. 15, 2018

Related U.S. Application Data

(60) Provisional application No. 62/385,504, filed on Sep. 9, 2016.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01); *F41B 5/105* (2013.01)

(58) Field of Classification Search
CPC ..... F41B 5/10
See application file for complete search history.

(56) References Cited

U.S. PATENT DOCUMENTS 3,574,944 A 4/1971 Reynolds
4,156,496 A 5/1979 Stinson
4,207,858 A 6/1980 Blackstone
4,377,152 A 3/1983 Saunders
4,452,222 A 6/1984 Quartino et al.
4,542,732 A 9/1985 Troncoso
4,596,228 A 6/1986 Smith
4,886,038 A 12/1989 Betters
4,903,678 A 2/1990 Walker
4,919,108 A 4/1990 Larson
5,178,122 A 1/1993 Simonds
5,392,757 A 2/1995 Head et al.
5,415,149 A 5/1995 Derus et al.
5,651,355 A 7/1997 Gallops, Jr.
5,697,355 A 12/1997 Schaffer
5,718,213 A 2/1998 Gallops, Jr. et al.
5,791,324 A 8/1998 Johnson
5,983,880 A 11/1999 Saunders
6,152,124 A 11/2000 Gallops, Jr.
6,176,231 B1 1/2001 Smith
6,425,385 B1 7/2002 Gallops, Jr.
6,532,945 B1 3/2003 Chattin
6,550,467 B2 4/2003 Gallops, Jr.
(Continued)

OTHER PUBLICATIONS

Walthert; U.S. Appl. No. 62/407,697, filed Oct. 13, 2016.
Batdorf; U.S. Appl. No. 15/254,706, filed Sep. 1, 2016.
Batdorf; U.S. Appl. No. 13/226,827, filed Sep. 7, 2011.

*Primary Examiner* — John Ricci
(74) *Attorney, Agent, or Firm* — Barclay Damon LLP

(57) ABSTRACT

An archery cord manager is described herein. The archery cord manager includes a plurality of ends, a body between the ends, and a cord engager supported by the body. The cord engager is configured to engage a cord of the bow. The cord engager is configured to move between an inward position and an outward position in response to the bow being transitioned between a drawn condition and an undrawn condition. The inward position is located closer to a draw cord plane than the outward position.

20 Claims, 28 Drawing Sheets

(56) References Cited

U.S. PATENT DOCUMENTS

| | | | |
|---|---|---|---|
| 6,634,348 | B2 | 10/2003 | Gallops, Jr. |
| 6,708,684 | B2 | 3/2004 | Chattin |
| 6,722,354 | B1 | 4/2004 | Land |
| 6,904,900 | B2 | 6/2005 | Gallops, Jr. |
| 7,793,646 | B2 | 9/2010 | Cooper et al. |
| 8,028,685 | B2 | 10/2011 | Clark |
| 8,371,283 | B2 | 2/2013 | Grace et al. |
| 8,402,960 | B2 | 3/2013 | McPherson |
| 8,424,511 | B2 | 4/2013 | Grace, Jr. et al. |
| 8,485,169 | B2 | 7/2013 | Dahl, II |
| 8,616,189 | B2 | 12/2013 | McPherson et al. |
| 8,651,097 | B2 | 2/2014 | Grace, Jr. et al. |
| 8,671,929 | B2 | 3/2014 | McPherson |
| 8,746,219 | B2 | 6/2014 | Anselmo |
| 8,746,220 | B2 | 6/2014 | McPherson et al. |
| 8,784,628 | B2 | 7/2014 | Grace, Jr. et al. |
| 8,813,737 | B2 | 8/2014 | Langley |
| 8,820,304 | B2 | 9/2014 | Batdorf |
| 8,950,388 | B2 | 2/2015 | McPherson |
| 9,291,422 | B1 | 3/2016 | Gold et al. |
| 2003/0056780 | A1 | 3/2003 | Gallops, Jr. |
| 2009/0165766 | A1 | 7/2009 | Evans |
| 2010/0101549 | A1 | 4/2010 | Grace et al. |
| 2010/0132685 | A1 | 6/2010 | De Sousa |
| 2011/0073090 | A1 | 3/2011 | McPherson |
| 2012/0042861 | A1 | 2/2012 | Anselmo |
| 2013/0055995 | A1 | 3/2013 | Batdorf |
| 2013/0055997 | A1 | 3/2013 | Badgerow |
| 2013/0061838 | A1 | 3/2013 | Gordon et al. |
| 2014/0299116 | A1 | 10/2014 | Yehle |
| 2015/0027425 | A1 | 1/2015 | Yehle |
| 2015/0153133 | A1 | 6/2015 | McPherson |

Drawn

Undrawn

ARCHERY CORD MANAGER

CROSS-REFERENCE TO RELATED APPLICATION

This application is a non-provisional of, and claims the benefit and priority of, U.S. Provisional Patent Application No. 62/385,504 filed on Sep. 9, 2016. The entire contents of such application are hereby incorporated by reference.

BACKGROUND

Some archery bows have a power cable in addition to a bowstring. The power cable and the bowstring are coupled to one or more rotary cams. The power cable can interfere with the passage of the arrow during shooting. For example, during flight, the fletching of the arrow can contact or become entangled with the power cable. Therefore, archers often use a known cable guard to provide clearance for the arrow when passing by the power cable. In operation, the known cable guard generates a lateral force on the cams.

This lateral force has several disadvantages. The lateral force can damage, bind or otherwise increase the wear and tear on the internal bearing components of the cams. The lateral force can also cause the cams to wobble during rotation, causing lateral movement in the bowstring which, in turn, can hinder shooting performance. In addition, the lateral force can cause torque or bending in the riser of the bow which can also hinder shooting performance. Furthermore, all of these disadvantages can affect the trajectory of the arrow and make it more difficult for the archer to fine-tune the archer's bow in efforts to achieve optimal shooting outcomes.

In operation, the known cable guard constantly generates this lateral force to keep the power cable away from the arrow. In other words, the cable guard applies this lateral force at all times throughout the full cycle of motion of the bowstring. This full-cycle lateral force impairs the cam for a relatively long period of time, magnifying the disadvantages described above.

The foregoing background describes some, but not necessarily all, of the problems, disadvantages and shortcomings related to the known cable guard.

SUMMARY

In an embodiment, an archery cord manager is described. The archery cord manager includes a first end configured to be coupled to a bow, a second end, and a body between the first and second ends. The bow includes a draw cord moveable in a draw cord plane to launch a projectile along a shooting axis. A cord engager is supported by the body and configured to engage a supplemental cord of the bow, the supplemental cord being configured to increase a launching force of the bow. When the cord engager is engaged with the supplemental cord, the cord engager is configured to move from an inward position to an outward position in response to the bow transitioning from a drawn condition to an undrawn condition. In the drawn condition, the draw cord is retracted and in the undrawn condition, the draw cord is released.

In another embodiment, an archery cord manager is described. The archery cord manager includes a first end configured to be coupled to a bow, a second end, and a body between the first and second ends. The bow includes a draw cord moveable in a draw cord plane to launch a projectile along a shooting axis. A body engager is moveably coupled to the body and includes a cord engager configured to engage a supplemental cord of the bow. The body engager is configured to move along the body relative to the shooting axis. The cord engager is configured to move from an inward position to an outward position in response to the bow being transitioned from a drawn condition to an undrawn condition. The outward position is located further from the draw cord plane than the inward position. In the drawn condition, the draw cord is retracted, and in the undrawn condition, the draw cord is released.

In yet another embodiment, a method for constructing an archery cord manager is described. The method includes structuring a first end so that the first end is configured to be coupled to an archery bow, structuring a second end, and structuring a body so as to extend between the first and second ends. The archery bow includes a draw cord moveable in a draw cord plane to launch a projectile along a shooting axis. The method further includes structuring a cord engager so that, when the cord engager is engaged with a supplemental cord of the bow, the cord engager is configured to: (a) move from an inward position to an outward position in response to the bow transitioning from a drawn condition to an undrawn condition; and (b) apply a variable lateral force to the supplemental cord in response to the bow transitioning from the drawn condition to the undrawn condition, the variable lateral force resulting in a lower sum of lateral forces on the supplemental cord during the drawn period than during the undrawn period. In the drawn condition, the draw cord is retracted, thereby starting a drawn period, and in the undrawn condition, the draw cord is released, thereby starting an undrawn period. The variable lateral force and the sum of lateral forces act along axes that intersect with the draw cord plane.

Additional features and advantages of the present disclosure are described in, and will be apparent from, the following Brief Description of the Drawings and Detailed Description.

DETAILED DESCRIPTION

Figure 1A:
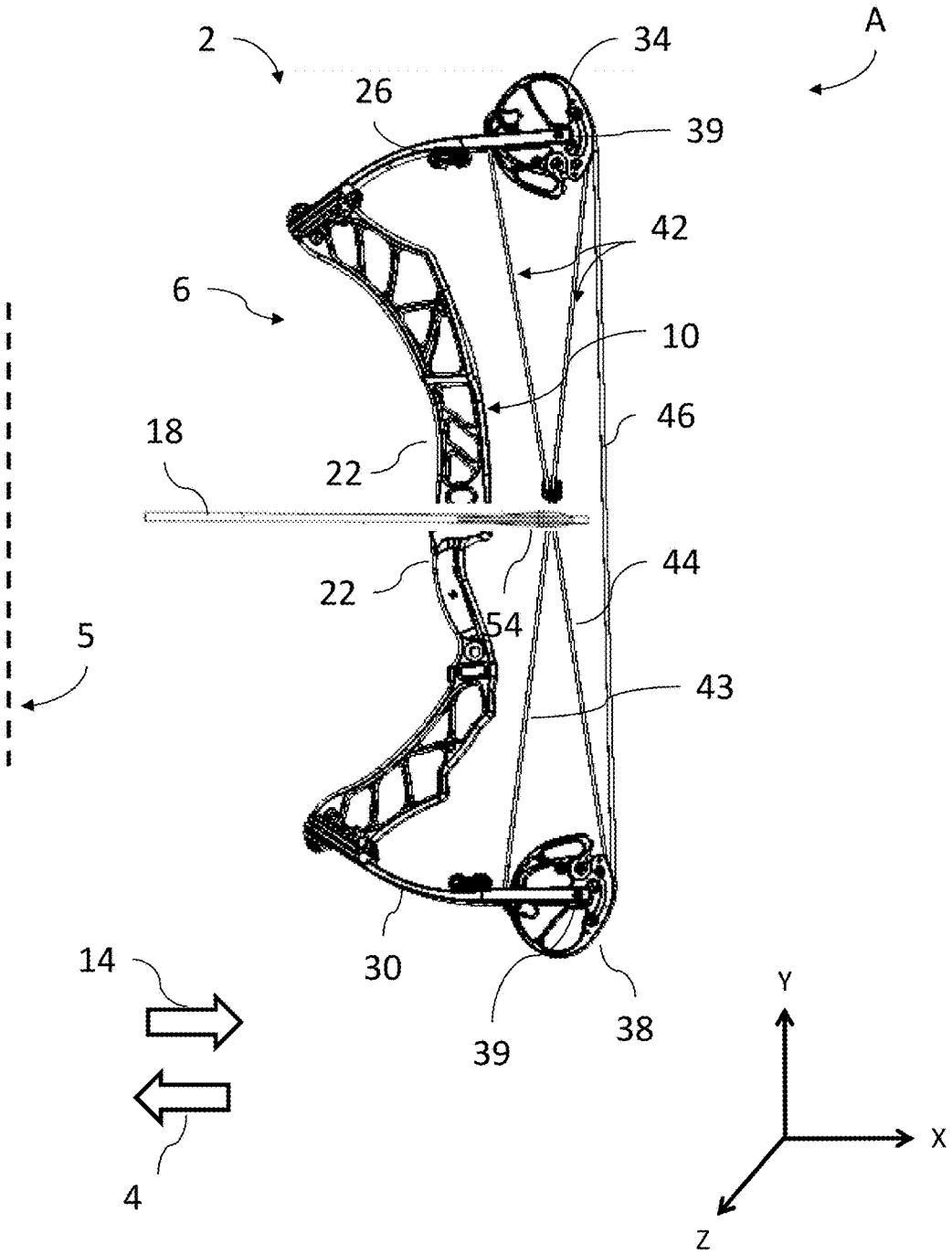
FIG. 1A is a side elevation view of an embodiment of an archery bow illustrated in the undrawn condition.
Figure 1B:
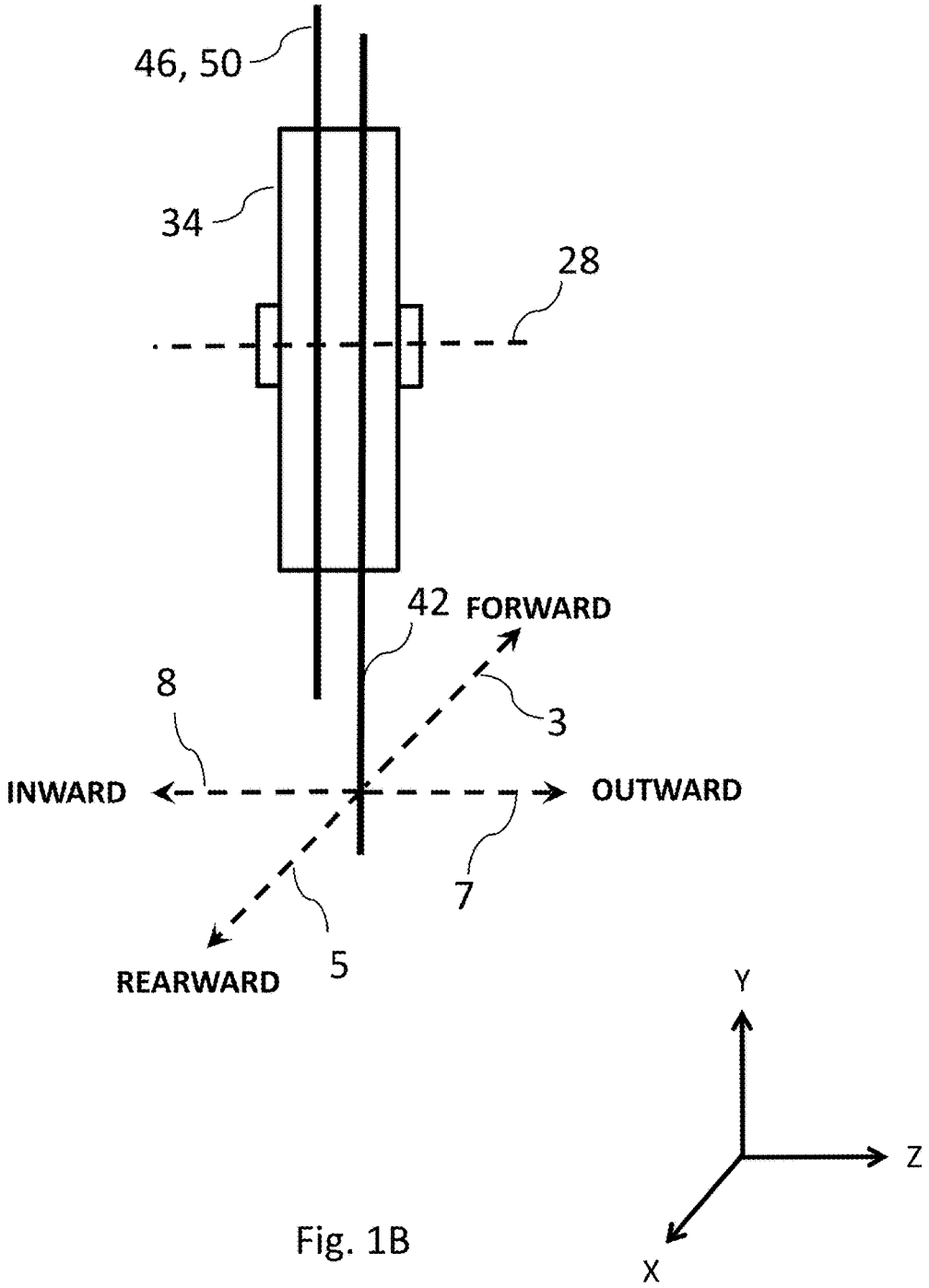
FIG. 1B is a schematic diagram of an example of various forces acting on a supplemental cord set and rotor of the archery bow of FIG. 1.
Figure 1C:
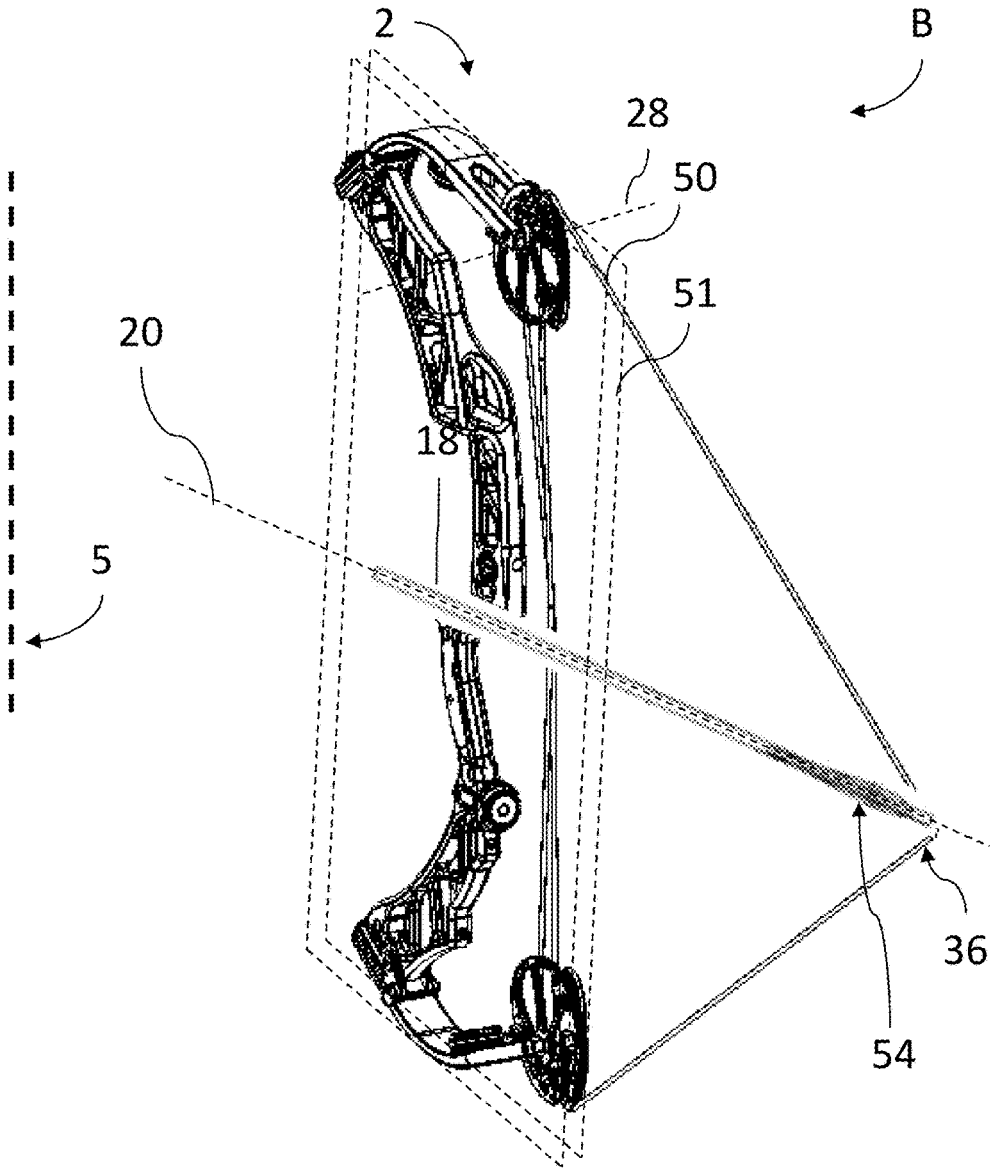
FIG. 1C is a rear isometric view of an embodiment of the archery bow of FIG. 1 illustrated in the drawn condition.

In an embodiment illustrated in FIGS. 1A-1C, an archery bow 2 has a front 6 facing in a forward direction 4 toward a shooting target 5 and a back 10 facing in a rearward direction 14 opposite the shooting target 5. The back 10 is positioned closer to an archer or user who readies the archery bow 2 in position to fire a projectile or arrow 18 along the shooting axis 20.

The archery bow 2 also includes a riser 22. A limb 26, 30 is coupled to each end of the riser 22. Referring to FIGS. 1A and 1B, a rotational wheel, pulley, cam or rotor 34, 38 is coupled to each limb 26, 30. In an embodiment, each of the rotors 34, 38 rotates about an axis 28. At least one of the rotors 34, 38 is an eccentric member, having one or more elliptical, asymmetric or non-circular lever portions configured to: (a) engage the draw cord 46; (b) engage the power line, power cord set or supplemental cord set 42; or (c) engage both the draw cord 46 and supplemental cord set 42. The draw cord 46 and supplemental cord set 42 are spooled on the rotors 34, 38. Draw cord 46 can include a bowstring, drawstring, draw cord, string, cord, cable, or any other flexible line configured to be drawn backward by the archer. Supplemental cord set 42 can include one or more supplemental cords, power cables, power cords, auxiliary cords, assistive cords, strings, cords, cables, or other flexible lines configured to pull the limbs 26, 30 together. By pulling the limbs 26, 30 together, the supplemental cord set 42 increases the spring force of the bow 2, thereby increasing the launching force of the bow 2.

In an embodiment, the supplemental cord set 42 has a plurality of supplemental cord segments 43, 44 arranged to cross each other in an X-fashion, as shown in FIG. 1A. The supplemental cord set 42 is coupled to at least one rotor 34, 38 at an anchor point 39. When the draw cord 46 is drawn rearward 14, the movement of the draw cord 46 causes the rotors 34, 38 to rotate toward each other. Because the supplemental cord set 42 is coupled to the anchor point 39 of at least one of the rotors 34, 38, the rotation of the rotors 34, 38 cause the supplemental cord set 42 to be taken-up during drawing of the draw cord 46, effectively shortening the length of the supplemental cord set 42 and drawing the limbs 26, 30 of the bow 2 closer together. Drawing the limbs 26, 30 together places them in more tension and generates potential energy that will be used to launch the arrow 18 upon release. In this way, the supplemental cord set 42 increases the shooting or launching power of the bow 2.

As illustrated in FIG. 1B, the draw cord 46 is movable within a draw cord plane 50 determined by the separated arrangement of the rotors 34, 38. In an embodiment, a central point 36 of the draw cord 46 travels within the draw cord plane 50 to launch the arrow 18 along the shooting axis 20. In an embodiment, the arrow 18 has a protrusion, tail or fletching 54 (FIG. 1C) to aid in the aerodynamic flight performance of the arrow 18. In an embodiment, the supplemental cord set 42 travels within the supplemental cord plane 51.

Figure 2A:
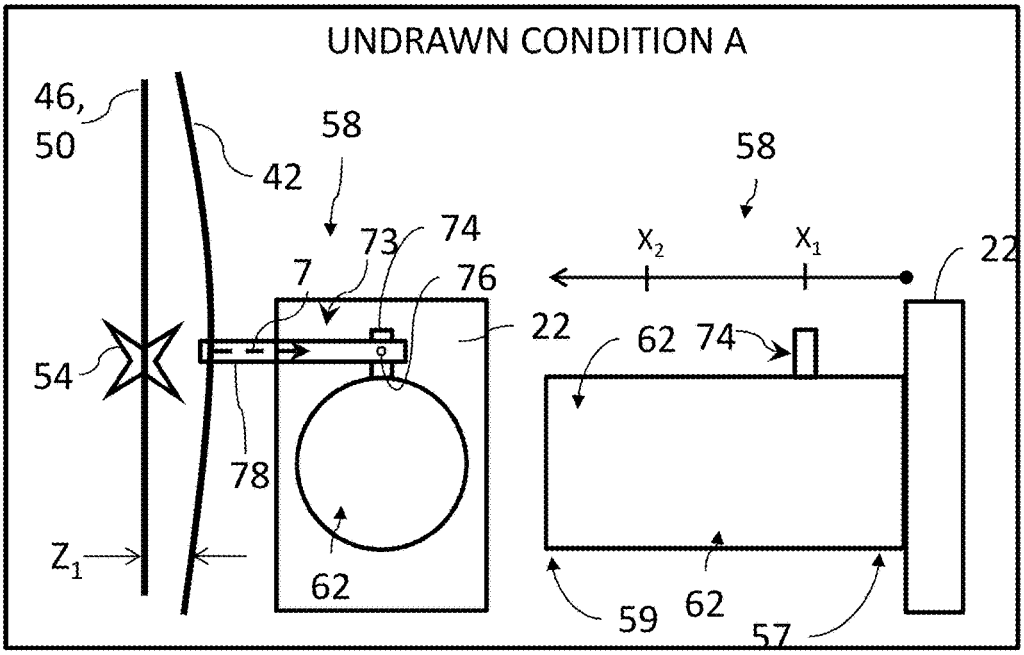
FIG. 2A is a schematic diagram of an embodiment of an archery cord manager interacting with a supplemental cord of an archery bow in an undrawn condition.
Figure 2B:
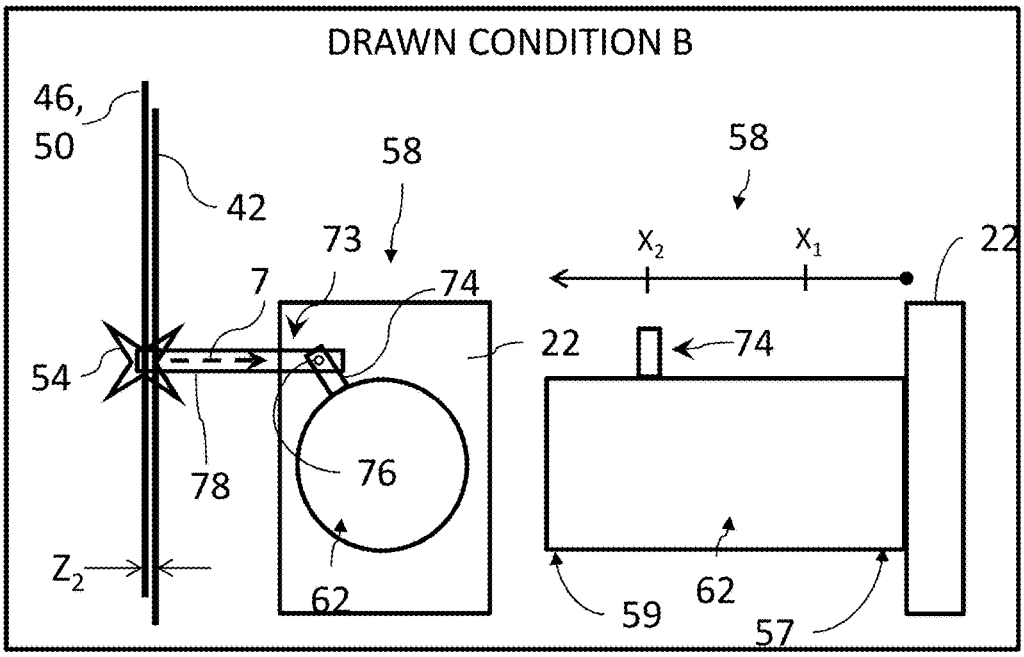
FIG. 2B is a schematic diagram of the archery cord manager of FIG. 2A interacting with the supplemental cord of the archery bow in a drawn condition.

The bow 2 is operable in a full draw cycle or full cycle. The full cycle of bow 2 starts with a brace, release or undrawn condition A (FIGS. 1A and 2A). Then, the bow 2 proceeds to a drawn condition B (FIGS. 1C and 2B). After the user releases the draw cord 46, the bow 2 returns to the brace, release or undrawn condition A.

In undrawn condition A (FIGS. 1A and 2A), the user is not pulling rearward 14 on the draw cord 46. The undrawn condition A can occur during a brace event or a release event. During a brace event, for example, the user has not yet pulled rearward 14 on the draw cord 46, so the draw cord 46 is positioned between the rotors 34, 38 in the undrawn condition A. During a release event, the user has already pulled rearward on the draw cord 46, the user has released the draw cord 46, and the draw cord 46 has returned to a location between the rotors 34, 38 in the undrawn condition A. The bow 2 remains in the undrawn condition A for an undrawn period of time until the user transitions the bow 2 to the drawn condition B.

In the drawn condition B (FIGS. 1C and 2B), the user has pulled or drawn the draw cord 46 in the rearward direction 14, and the user is holding the draw cord 46 in a tight, retracted state. The bow 2 remains in the drawn condition B for a drawn period of time until the user releases the draw cord 46, which enables the bow 2 to transition to the undrawn condition A. After the user releases the retracted draw cord 46, the bow 2 returns to undrawn condition A, the generated potential energy is expended, and the draw cord 46 travels in the forward direction 4 toward the target 5. As described below, each of the archery cord managers 58, 58*a*, 58*b*, 58*c*, 58*d*, 58*e*, 58*f*, 58*g* and 58*h* is operable to minimize or reduce the particular time period during which a peak outward force or lateral clearance force 7 (FIGS. 1B, 2A, and 2B) or sum of lateral forces acts on the supplemental cord set 42.

Referring to FIGS. 2A-2B, in an embodiment, the archery cord manager 58 includes: (a) a first end or mount end 57 configured to be coupled to the riser 22 of bow 2; (b) a second end or free end 59 opposite the mount end 57; (c) a body 62 between the mount and free ends 57, 59; and (d) a body engager 73 moveably coupled to the body 62.

The body engager 73 has: (a) a body coupler 74 which is rotatably, slideably or moveably attached to the body 62; and (b) a cord engager or cord holder 78 configured to hold, hook, grasp or engage the supplemental cord set 42. In an embodiment, the segments 43, 44 of the supplemental cord set 42 are held apart on the cord engager 78 to prevent interference with each other. In the embodiment shown, the cord engager 78 is moveably or pivotally coupled to the body coupler 74 through a pivot member 76.

The body engager 73 has multiple degrees of freedom relative to the body 62. The body engager 73 is configured to axially translate, slide or move along the body 62 relative to the shooting axis 20 (FIG. 1C). For example, the body engager 73 is configured to move from position $X_1$ in the undrawn condition A (FIG. 2A) to position $X_2$ in the drawn condition (FIG. 2B). During such axial or translational movement, the cord engager 78 is also configured to move between an outward position O (e.g., 12 o'clock) in the undrawn condition (FIG. 2A) and an inward position I (e.g., 11 o'clock) in the drawn condition (FIG. 2B). When the body engager 73 is in position $X_1$, the supplemental cord set 42 is in the outward position O. When the body engager 73 is in position $X_2$, the supplemental cord set 42 is in the inward position I.

As shown, the inward position I is located closer to the draw cord 46 (and draw cord plane 50) than the outward position O. As indicated for this example, supplemental cord set 42 is separated from draw cord 46 by distance $Z_1$ in the undrawn condition A, and supplemental cord set 42 is separated from draw cord 46 by distance $Z_2$ in the drawn condition B. Distance $Z_1$ is greater than distance $Z_2$ to provide clearance space for the arrow fletching 54. Distance $Z_2$ can be relatively small, such as the thickness or diameter of the arrow 18. In an embodiment not shown, distance $Z_2$ is nearly zero because the archery cord manager 58 holds the supplemental cord set 42 in the drawn condition B so that both the supplemental cord set 42 and the draw cord 46 temporarily lie in nearly the same draw cord plane 50, the distance $Z_2$ being the diameter of the arrow 18. In another embodiment (not shown), in which an arrow 18 is not loaded in the bow 2, the distance $Z_2$ is zero. As the bow 2 transitions to the undrawn condition A, the archery cord manager 58 gradually distances the supplemental cord set 42 from the draw cord plane 50 to provide clearance for the arrow 18 and its fletching 54.

In an example operation, the user pulls back on the draw cord 46 in the rearward direction 14. Because of the shapes and rotation of the rotors 34, 38, the rotors 34, 38 transfer a rearward force 5 (FIG. 1B) on the supplemental cord set 42, which acts in the rearward direction 14 (FIG. 1A). This rearward force 5 causes the supplemental cord set 42 to move in the rearward direction 14. Since the cord engager 78 is hooked onto or otherwise engaged with the supplemental cord set 42, the supplemental cord set 42 drags or pulls the cord engager 78 rearward in the rearward direction 14.

In an embodiment, the cord engager 78 has a relatively low frictional interface with the body 62, enabling the cord engager 78 to freely translate, slide or move along the length of the body 62. Consequently, when the draw cord 46 causes a rearward force 5 (FIG. 1B) on the cord engager 78, the cord engager 78 translates rearward along the body 62. Likewise, when the draw cord 46 causes a forward force 3 (FIG. 1B) on the cord engager 78, the cord engager 78 translates forward along the body 62 in the forward direction 4 (FIG. 1A). Therefore, in an embodiment, the archery cord manager 58 does not push, pull or bias the supplemental cord set 42 in the rearward direction 14 or forward direction 4. Rather, the supplemental cord set 42 reacts to fore-aft draw cord forces, freely sliding or moving: (a) in the rearward direction 14 when the user transitions the bow 2 to the drawn condition B; or (b) in the forward direction 4 when the user releases the draw cord 46, causing the bow 2 to transition to the undrawn condition A.

As described above, in the drawn condition B, the draw cord 46 is retracted, and in the undrawn condition A, the draw cord 46 is released. The body engager 73 of the cord engager 78 moves from the inward position Ito the outward position O in response to the bow 2 being transitioned from the drawn condition B to the undrawn condition A. Consequently, during the particular time period when the arrow fletching 54 will be close or next to the supplemental cord set 42, the archery cord manager 58 distances the supplemental cord set 42 away from the fletching 54. In an embodiment, the archery cord manager 58 limits such distancing function to such particular time period rather than maintaining such distancing function throughout the entire cycle of the bow 2. As described below, this improves shooting performance and reduces wear, damage and malfunctioning of the bow 2.

It should be understood that, when the cord engager 78 is engaged or in contact with the supplemental cord set 42, the cord engager 78 can apply a lateral force (inward or outward) to the supplemental cord set 42. In an embodiment, this lateral force is insignificant or relatively small during the drawn period when the bow 2 is in the drawn condition B. In another embodiment, the sum of the lateral forces (inward and outward) on the supplemental cord set 42, including the lateral forces imparted by the cord engager 78 and rotors 34, 38, is insignificant or relatively small during the drawn period when the bow 2 is in the drawn condition B. Therefore, in the drawn condition B, when the arrow fletching 54 is not at risk of interfering with the supplemental cord set 42, the cord engager 78 reduces or minimizes the magnitude of lateral forces (or the sum of lateral forces) acting on the supplemental cord set 42. As a result, this reduces the transfer of harmful lateral forces to the rotors 34, 38 at least during the drawn period.

Figure 3:
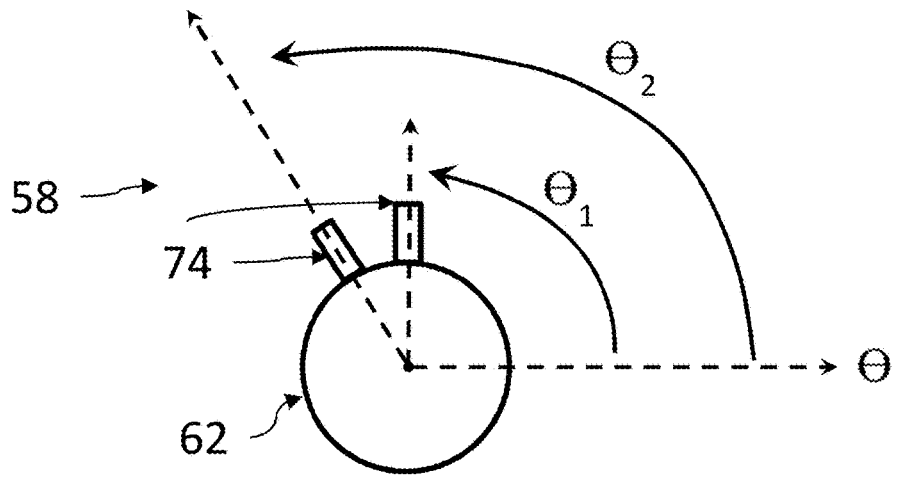
FIG. 3 is a schematic diagram of an example of pivotal or rotational movement of the archery cord manager of FIG. 2A.
Figure 4:
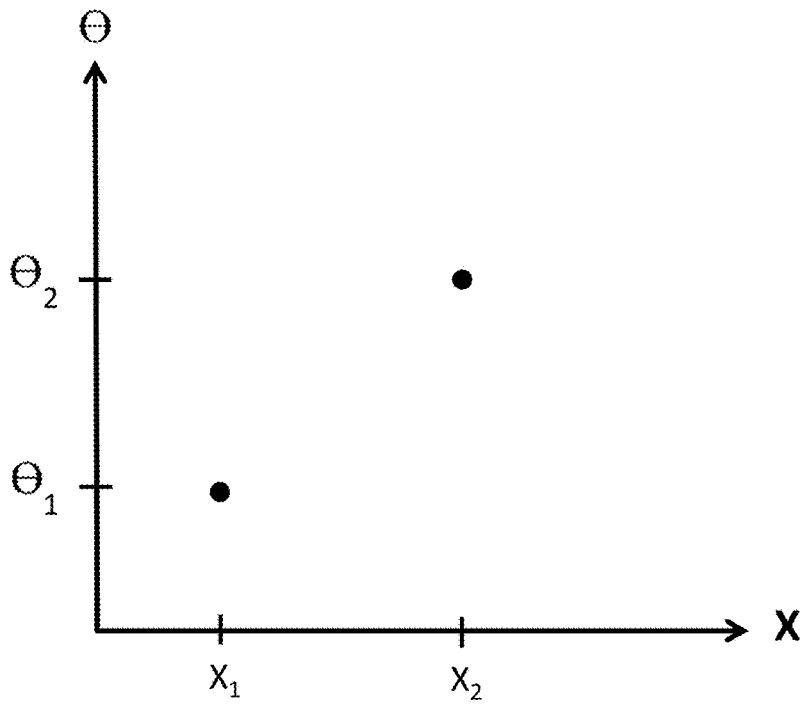
FIG. 4 is a graph illustrating the pivotal or rotational movement of the archery cord manager of FIG. 2A.
Figure 5A:
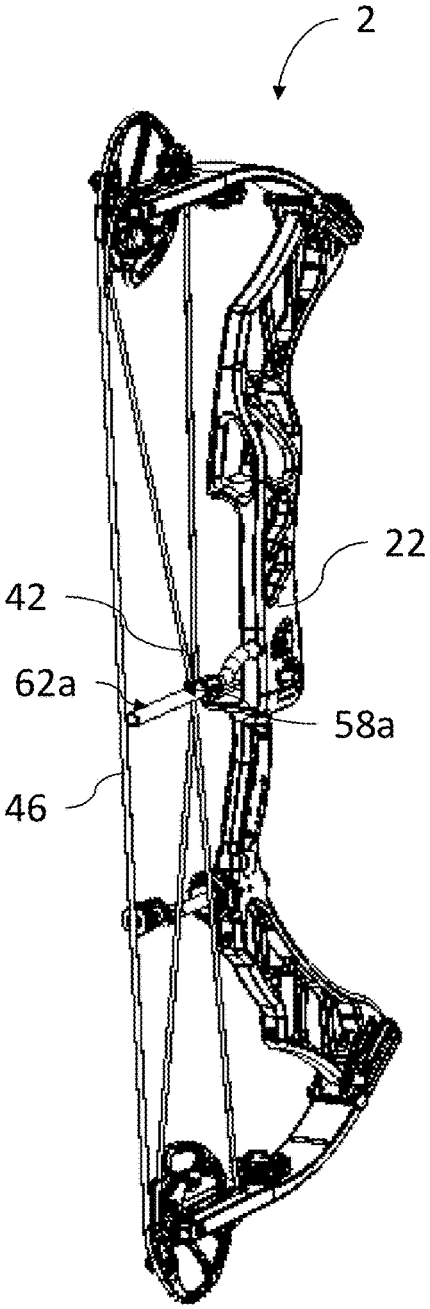
FIG. 5A is a rear isometric view of an embodiment of an archery cord manager mounted on an archery bow in the undrawn condition.
Figure 5B:
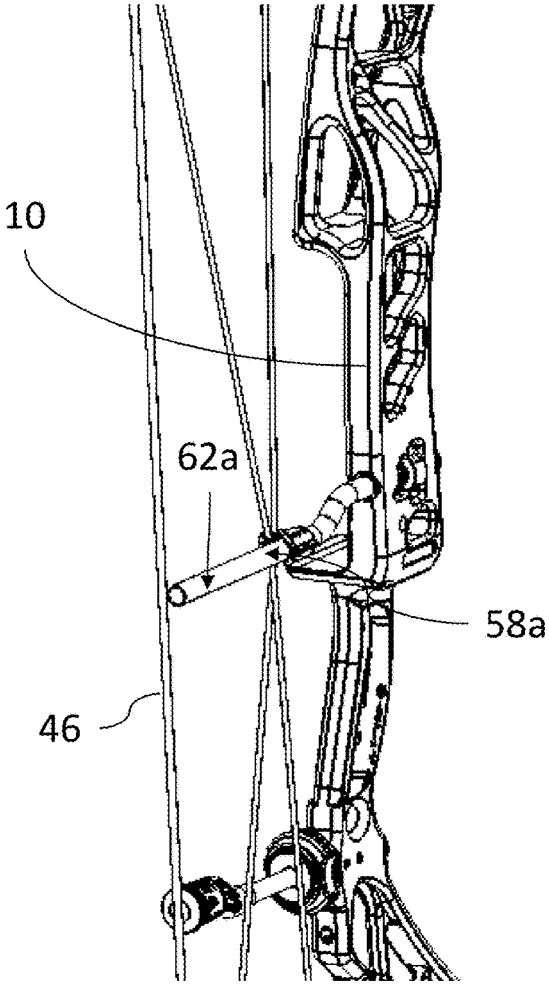
FIG. 5B is an enlarged view of the archery cord manager of FIG. 5A.
Figure 6A:
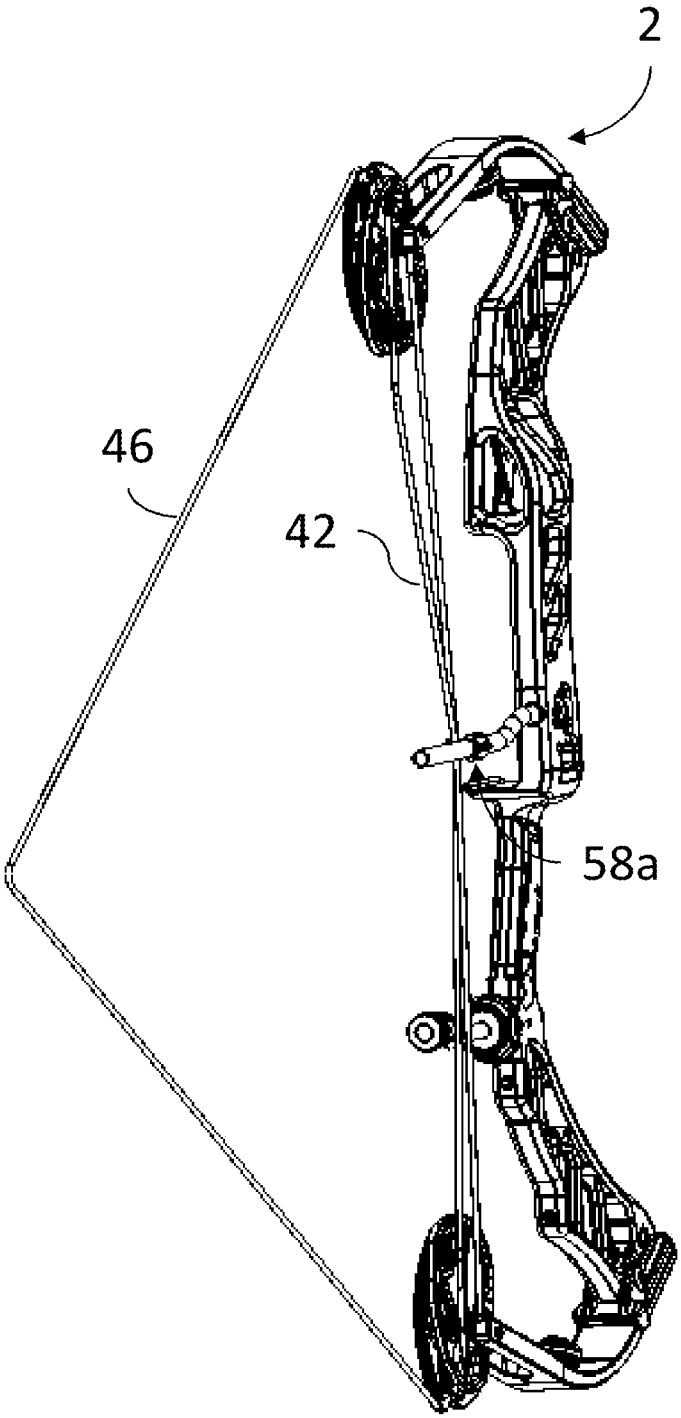
FIG. 6A is a rear isometric view of the archery cord manager of FIG. 5A mounted on the archery bow in the drawn condition.
Figure 6B:
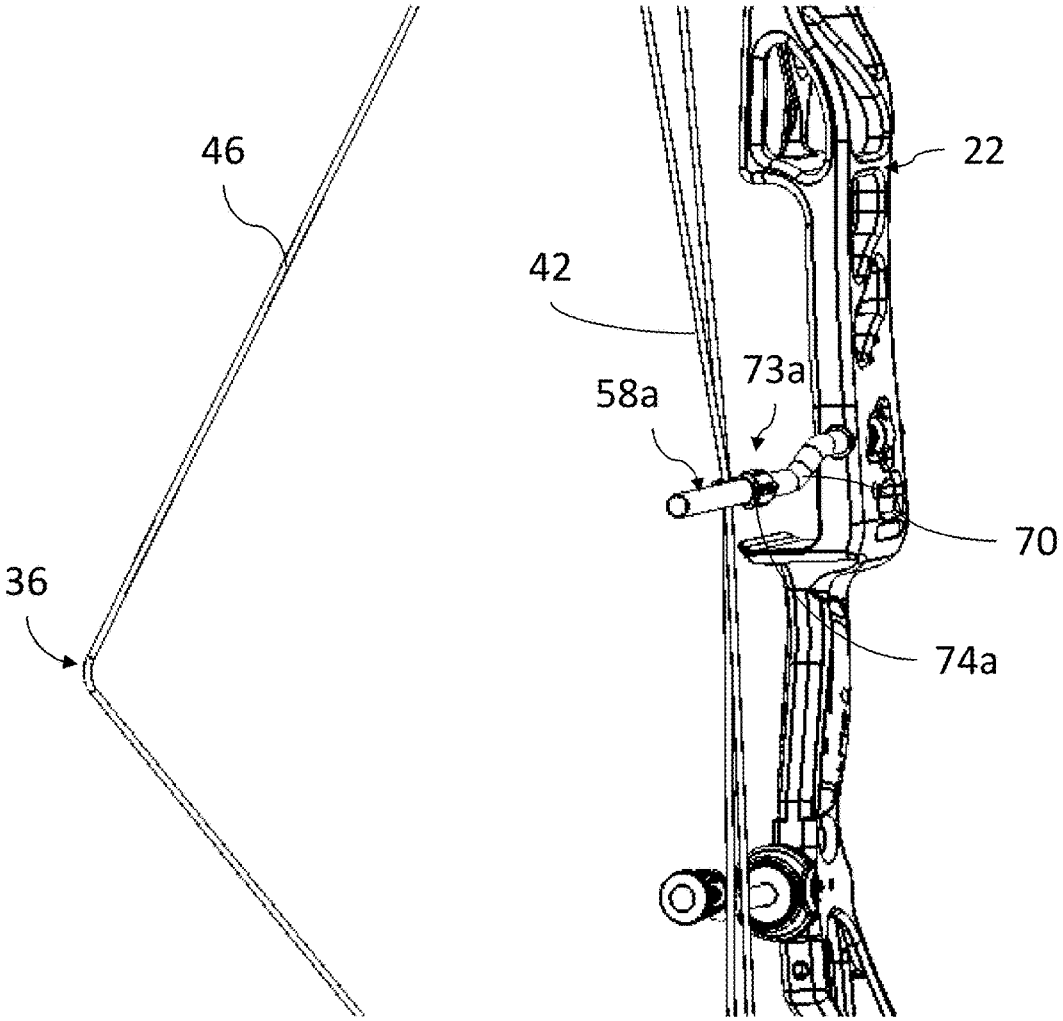
FIG. 6B is an enlarged view of the archery cord manager of FIG. 6A.

As illustrated in FIG. 3, in an embodiment, the body coupler 74 rotates relative to the body 62 while the body coupler 74 (along with the cord engager, not shown) translates, slides or moves along the length of the body 62 between, for example, positions $X_1$ and $X_2$ (FIGS. 2A-2B). In the example shown, the body coupler 74 is positioned at angle $\theta_1$ in the undrawn condition A, and the body coupler 74 is positioned at angle $\theta_2$ in the drawn condition B. During the full cycle from the undrawn condition A to the drawn condition B and back to the undrawn condition B, the angular position of the body coupler 74 dynamically changes from angle $\theta_1$ to angle $\theta_2$ and back to angle $\theta_1$. As illustrated in FIG. 4, when the body coupler 74 is at position $X_1$, the body coupler 74 is positioned at angle $\theta_1$, and when the body coupler 74 is at position $X_2$, the body coupler 74 is positioned at angle $\theta_2$. As set forth in the following table, the archery cord manager 58 dynamically regulates the position of the supplemental cord set 42 to minimize or reduce the duration of the lateral clearance force 7 on the supplemental cord set 42 which, in turn, minimizes or reduces the destructive, damaging and performance-hindering forces within the bow 2 and on the rotors 34, 38.

TABLE 1

| Condition | Z Distance | X Position | Angular Position |
|---|---|---|---|
| A: Undrawn | $Z_1$ | $X_1$ | $\Theta_1$ |
| B: Drawn | $Z_2$ | $X_2$ | $\Theta_2$ |
| A: Undrawn | $Z_1$ | $X_1$ | $\Theta_1$ |

In the embodiment illustrated in FIGS. 2A-3, the archery cord manager 58 is operable to rotate in a designated convention in which the body coupler 74 rotates clockwise in the transition to undrawn condition A, and the body coupler 74 rotates counterclockwise in the transition to the drawn condition B. It should be appreciated, however, that the body coupler 74 can rotate according to an opposite convention in other embodiments. For example, in an embodiment not shown, the body coupler 74 is connected to the bottom of the body 62. In such embodiment, the archery cord manager 58 is operable to rotate in an opposite convention in which the body coupler 74 rotates counterclockwise in the transition to undrawn condition A, and the body coupler 74 rotates clockwise in the transition to the drawn condition B.

As illustrated in FIGS. 5A-8, the archery cord manager 58*a* can be coupled or mounted to the archery bow 2. For example, the archery cord manager 58*a* can be coupled to the back 10 of the riser 22. In this embodiment, the archery cord manager 58*a* has an offset arm or multi-axial body 62*a*. The multi-axial body 62*a* includes a plurality of portions or body segments 66, 67, 70 extending along different body axes A1, A2, A3, respectively (FIG. 7B). The offset body segment 67 can include a bent portion or elbow 68 at the distal end 69 of the first body segment 66. The proximal end 71 of the first body segment 66 is inserted into the riser 22.

The second body segment 70 extends from the offset body segment 67 in the rearward direction 14 (FIG. 1A). In an embodiment, each of the first and second body segments 66, 70 is straight or linear, and the offset body segment 67 is angled or slanted relative to the first and second body segments 66, 70.

The archery cord manager 58*a* also includes a body engager 73*a* having a sleeve member or body coupler 74*a* and a cord engager or holder 78*a*. The body coupler 74*a* is moveably coupled to the multi-axial body 62*a*. For example, the body coupler 74*a* can be a sleeve encircling the linear second body segment 70 of the multi-axial body 62*a*. The cord engager 78*a* is moveably or pivotally coupled to the body coupler 74*a*, and the cord engager 78*a* hooks, holds or engages a flexible, power-enhancing line set, such as supplemental cord set 42, of the bow 2.

Figure 7A:
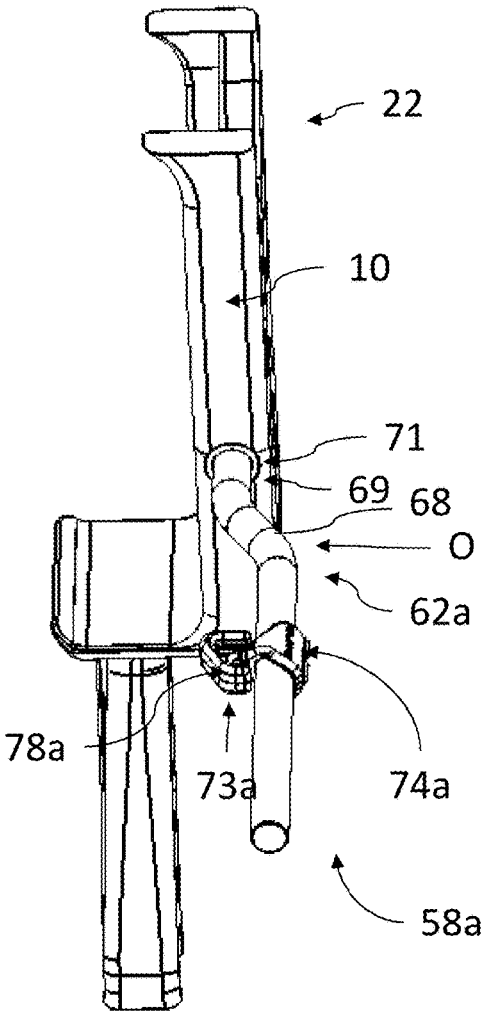
FIG. 7A is a rear isometric view of the archery cord manager of FIG. 5A mounted on a riser in the undrawn condition, illustrating the cord engager in the outward position.
Figure 7B:
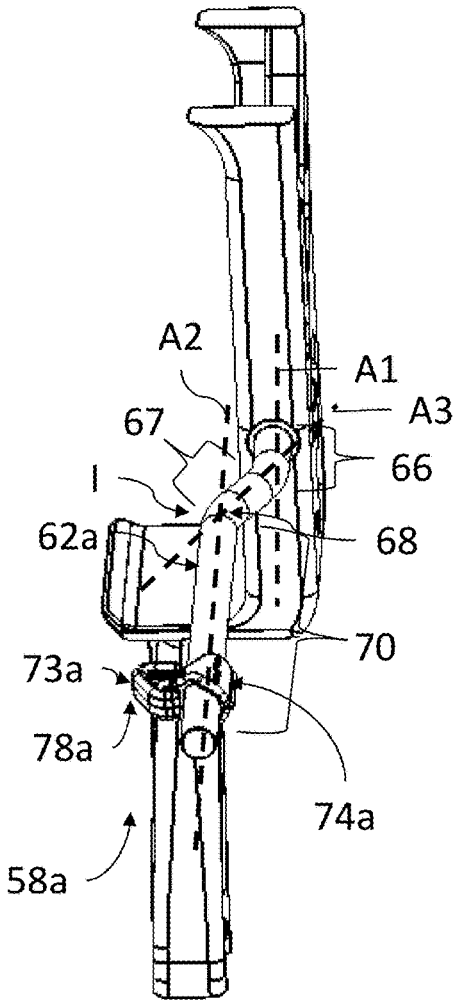
FIG. 7B is a rear isometric view of the archery cord manager of FIG. 5A mounted on a riser in the drawn condition, illustrating the cord engager in the inward position.
Figure 8:
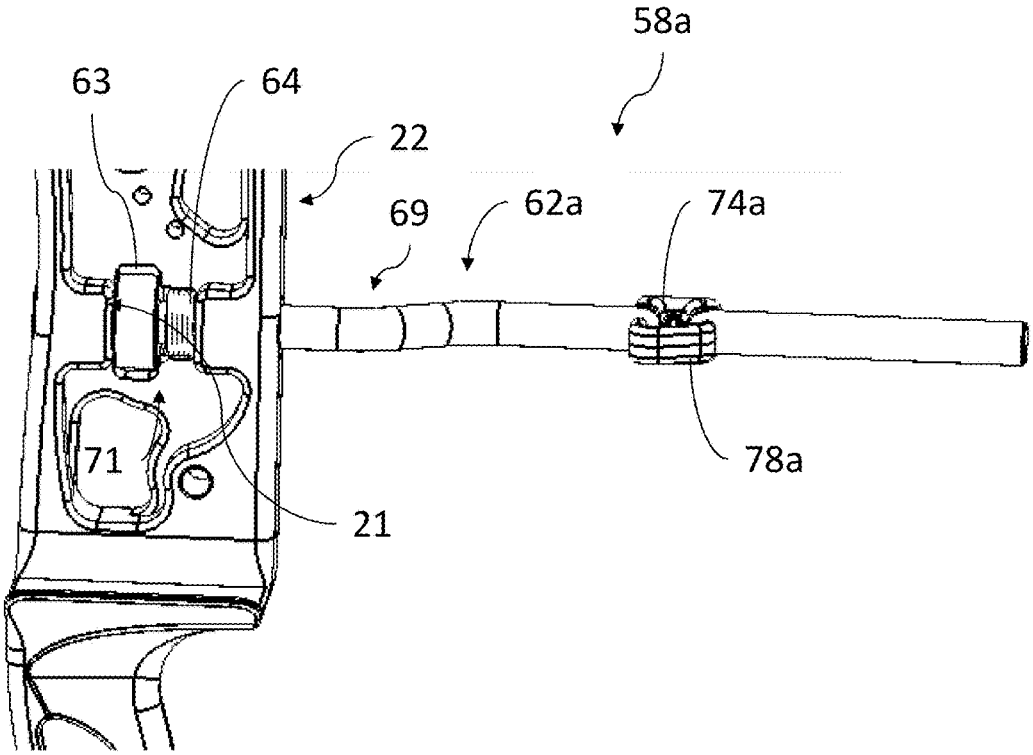
FIG. 8 is a side view of the archery cord manager of FIG. 5A mounted on a riser of the archery bow in the undrawn condition.
Figure 9B:
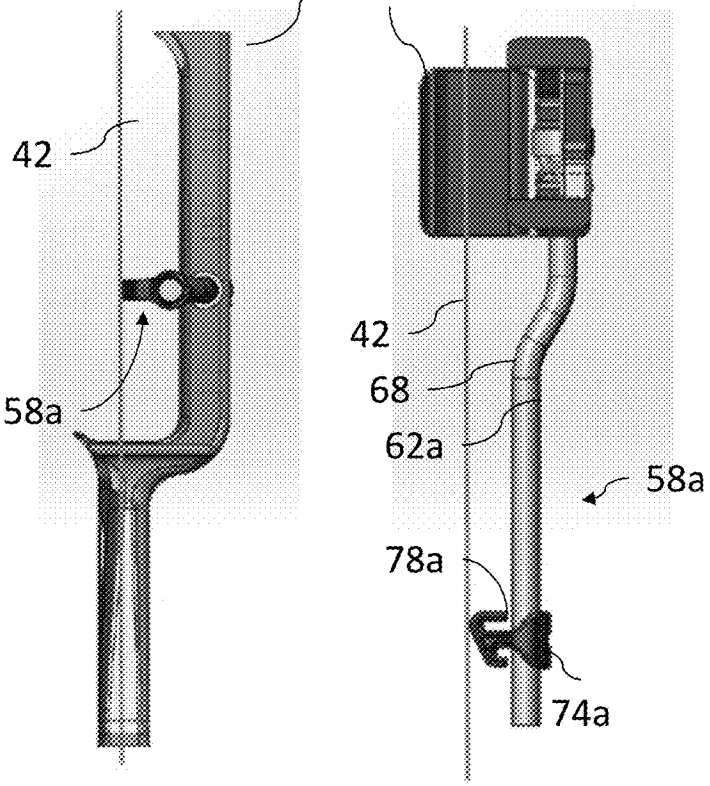
FIG. 9B is a rear view and top view of the archery cord manager of FIG. 5A mounted on the riser of the archery bow in the drawn condition, illustrating the cord engager in the inward position.
Figure 9A:
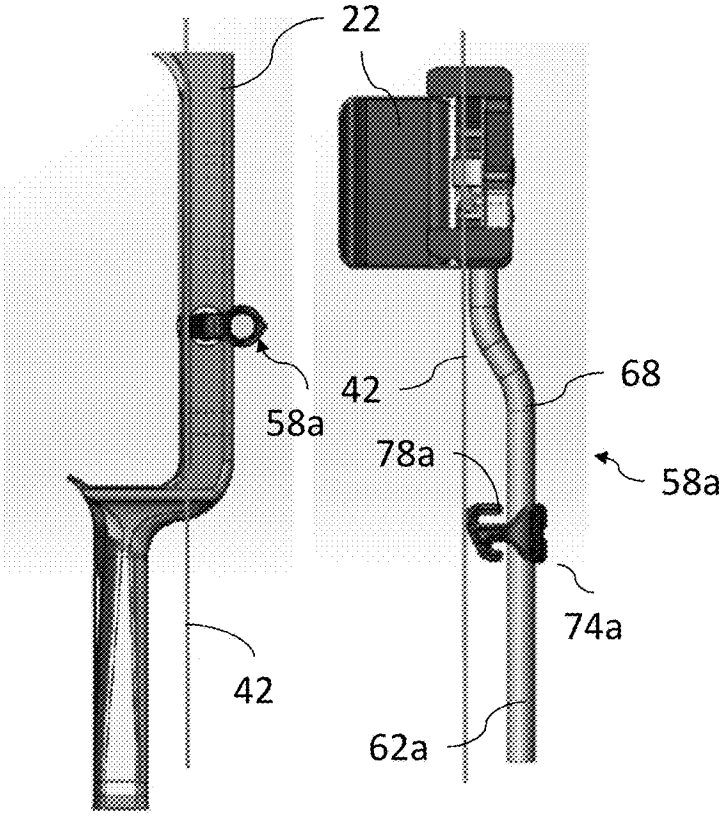
FIG. 9A is a rear view and top view of the archery cord manager of FIG. 5A mounted on the riser of the archery bow in the undrawn condition, illustrating the cord engager in the outward position.

As illustrated in FIG. 8, the multi-axial body 62*a* of the archery cord manager 58*a* can be inserted within the riser 22. In this embodiment, a stop member 63 is positioned between the back wall 21 of the riser 22 and the multi-axial body 62*a*. A biasing member 64, such as a spring, is coupled to the multi-axial body 62*a* and sandwiched between the riser 22 and stop member 63. The biasing member 64 exerts a constant or persistent biasing, torsion force on the multi-axial body 62*a*. This torsion force rotationally positions the second body segment 70 so as to position the cord engager 78 in the outward position O for the undrawn condition A (FIGS. 7A and 9A).

In an embodiment, the biasing member 64 has a first biasing portion forced against the stop member 63 or riser 22. The biasing member 64 has a second biasing portion forced against a protrusion or engagement portion of the first body segment 66 of the multi-axial body 62*a*. Accordingly, the biasing member 64 is installed onto the first body segment 66 and within the riser 22 in a fashion that generates a constant or persistent torsion force on the multi-axial body 62. As described above, this persistent torsion force predisposes the cord engager 78*a* to be located in the outward position O for the undrawn condition A (FIGS. 7A and 9A).

Referring back to FIGS. 5A-5B, 7A, and 9B, in the undrawn condition A, the multi-axial body 62*a* of the archery cord manager 58*a* experiences the constant or persistent biasing force exerted by the biasing member 64. This holds the multi-axial body 62 in the outward position O. In this outward position O, the supplemental cord set 42 is held by the cord engager 78*a*, and the body coupler 74*a* and the multi-axial body 62*a* cooperate to hold or position the supplemental cord set 42 laterally outside the draw cord plane 50. In the example shown in FIG. 7A, the archery cord manager 58*a* is operable to hold the elbow 68 of the multi-axial body 62*a* at a "3 o'clock" position in the outward position O. This locates the supplemental cord set 42 away from the arrow 18 (FIG. 1A), preventing or minimizing interference with the arrow 18 during the undrawn period.

Referring to FIGS. 6A-6B, 7B, and 9B, as the draw cord 46 moves from the undrawn condition A to the drawn condition B, the supplemental cord set 42 experiences, in an embodiment: (a) a rearward force 5 (FIG. 1B) acting in the rearward direction 14 (FIG. 1A); and (b) several lateral forces, including: (i) as the transition from the undrawn condition A to the drawn condition B begins and continuing partway through the transition, the outward lateral clearance force 7 (FIG. 1B) generated by the biasing member 64; and (ii) the counteractive, inward lateral bow force 8 (FIG. 1B) generated by the rotors 34, 38 in opposition to the outward lateral clearance force 7.

In an embodiment, the drawing back of the draw cord 46 causes the rotors 34, 38 to rotate. The one or more lever arm portions of the rotors 34, 38 impart the rearward force 5 on the supplemental cord set 42. The inward lateral bow force 8 urges the supplemental cord set 42 towards the draw cord plane 50. When the inward lateral bow force 8 exceeds the outward lateral clearance force 7 generated by the archery cord manager 58*a*, a plurality of reactions occur.

In the first reaction, the body coupler 74*a* translates or slides along the linear second body segment 70 of the multi-axial body 62*a* in the rearward direction 14. In the second reaction, the inward lateral bow force 8 overcomes the lateral clearance force 7 which causes the multi-axial body 62*a* to rotate toward the draw cord plane 50 until the elbow 68 of the multi-axial body 62*a* moves to, or close to, the draw cord plane 50 when the bow 2 is in the drawn condition B. In an embodiment, this enables the supplemental cord set 42 to be located within or substantially within the draw cord plane 50, reducing the duration of problematic lateral forces on the rotors 34, 38. In the example shown in FIG. 7B, in the drawn condition B, the elbow 68 is located at a "9 o'clock" position. In this drawn condition B, the supplemental cord set 42 is positioned close to or within the draw cord plane 50.

Referring to FIG. 1B, in an example, when the bow 2 is in the undrawn condition A, the inward lateral bow force 8 acting on the supplemental cord set 42 is zero pounds of force, and the outward lateral clearance force 7 acting on the supplemental cord set 42 is sixteen pounds of force. As the bow 2 transitions to the drawn condition B, the inward lateral bow force 8 exerted by the rotors 34, 38 increases. For example, at a sixteen inch pull-back or draw of the draw cord 46, the inward lateral bow force 8 increases to twenty-four pounds of force, and at a twenty-two inch draw, the inward lateral bow force 8 increases to thirty-seven pounds of force, and at a thirty inch draw, the inward lateral bow force 8 increases to forty-three pounds of force.

By the time the bow 2 reaches the drawn condition B, the inward lateral bow force 8 has increased to overcome the outward lateral clearance force 7. This causes the multi-axial body 62 to pivot or rotate (in this example, counterclockwise, although in another embodiment, the multi-axial body 62 could rotate clockwise), moving the cord engager 78*a* closer to or within the draw cord plane 50. At this position, the cord engager 78*a* positions the supplemental cord set 42 so as to reduce, minimize or eliminate the sum of the outward lateral clearance force 7 and the inward lateral bow force 8.

When the user releases the draw cord 46, such as when the arrow 18 is launched, the inward lateral bow force 8 is reduced as the draw cord 46 moves within the draw cord plane 50 to the undrawn condition A, and the outward lateral clearance force 7 overcomes the inward lateral bow force 8. This causes the multi-axial body 62*a* of the archery cord manager 58*a* to pivot or rotate (in this example, clockwise, although in another embodiment, the multi-axial body 62 could rotate counter-clockwise) to move the cord engager 78*a* further away from the draw cord plane 50. Accordingly, during this transition from drawn condition A to undrawn condition B, the cord engager 78*a* applies a variable sum of lateral forces to the supplemental cord set 42. In an embodiment, this force sum varies from a relatively low lateral force sum in the drawn condition A to a relatively high lateral force sum in the undrawn condition B. While the outward and inward positions O, I of the elbow 68 have been described herein as "3 o'clock" and "9 o'clock", it is to be understood that any suitable positions can be utilized. For example, the outward and inward positions O, I of the elbow 68 can vary within a range of zero to thirty degrees.

In another embodiment not shown, the multi-axial body 62*a* is differently positioned so that, for example, the elbow 68 faces outward O in the undrawn condition A, and the elbow 68 faces downward in the drawn condition B. In such embodiment, the archery cord manager 58*a* is operable to rotate in an opposite convention in which the body coupler 74*a* rotates counterclockwise in the transition to undrawn condition A, and the body coupler 74*a* rotates clockwise in the transition to the drawn condition B.

Referring to FIGS. 10A-13B, another embodiment of an archery cord manager 58*b* is illustrated. In this embodiment, the archery cord manager 58*b* is coupled to or mounted on the riser 22 of the bow 2. The archery cord manager 58*b* includes a body 62*b*. In an example, the body 62*b* can be a linear shaft or rod. The body 62*b* of the archery cord manager 58*b* can be coupled to the riser 22 of the bow 2 in any suitable manner. For example, the body 62*b* of the archery cord manager 58*b* can be received in a bore hole (not shown) of the riser 22. In an example, the body 62*b* is fixedly coupled to the riser 22 through a press-fit, fastener-based or other suitable securing configuration.

The archery cord manager 58*b* also includes a body engager 73*b* including a body coupler 74*b* and a cord engager 78*b*. The cord engager 78*b* is coupled to the body coupler 74*b* and is configured to hold the supplemental cord set 42. In an example, the cord engager 78*b* can be coupled to the body coupler 74*b* by a hinged joint 98 (FIG. 12B). The cord engager 78*b* can have any suitable shape. For example, the cord engager 78*b* can have a T-shape, U-shape, hooked shape or double-hooked shape. In the embodiment illustrated in FIG. 13A, the cord engager 78*b* has a T-shape defining: (a) a cord slot 90 configured to receive supplemental cord segment 43; and (b) a cord slot 94 configured to receive supplemental cord segment 44. The body coupler 74*b* can have any suitable shape. In the illustrated embodiment, the body coupler 74*b* has a tubular or hollow, cylindrical shape.

Figure 10A:
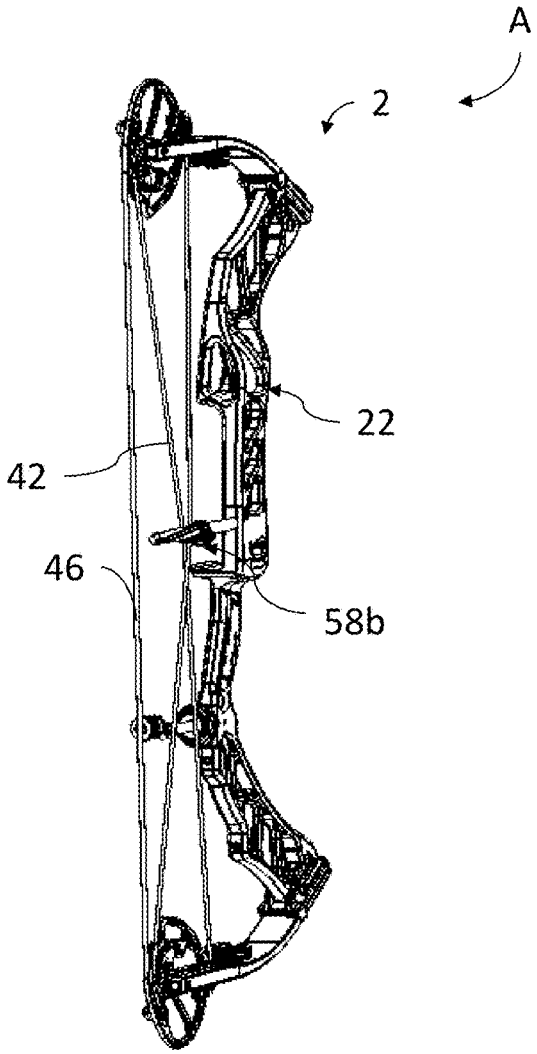
FIG. 10A is a rear isometric view of another embodiment of an archery cord manager mounted on an archery bow in the undrawn condition.
Figure 10B:
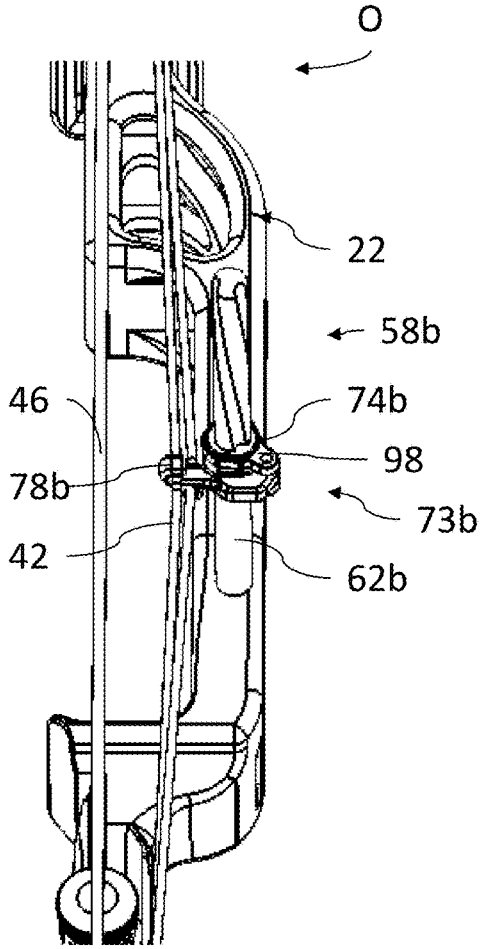
FIG. 10B is an enlarged rear view of the archery cord manager of FIG. 10A mounted on the archery bow.
Figure 12A:
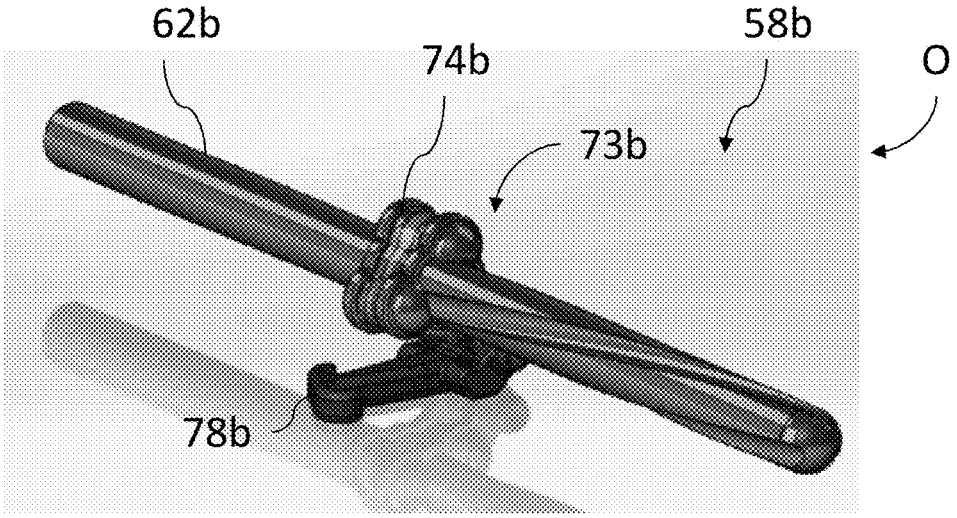
FIG. 12A is a side isometric view of an embodiment of the archery cord manager of FIG. 10A, illustrating its position in an undrawn condition of the archery bow.
Figure 12B:
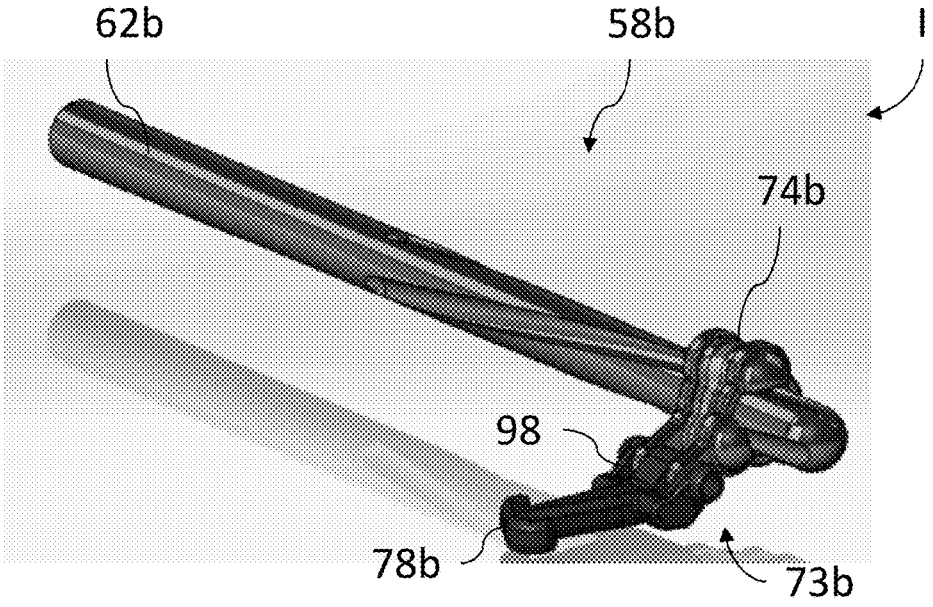
FIG. 12B is a side isometric view of the archery cord manager of FIG. 10A, illustrating its position in a drawn condition of the archery bow.
Figure 13A:
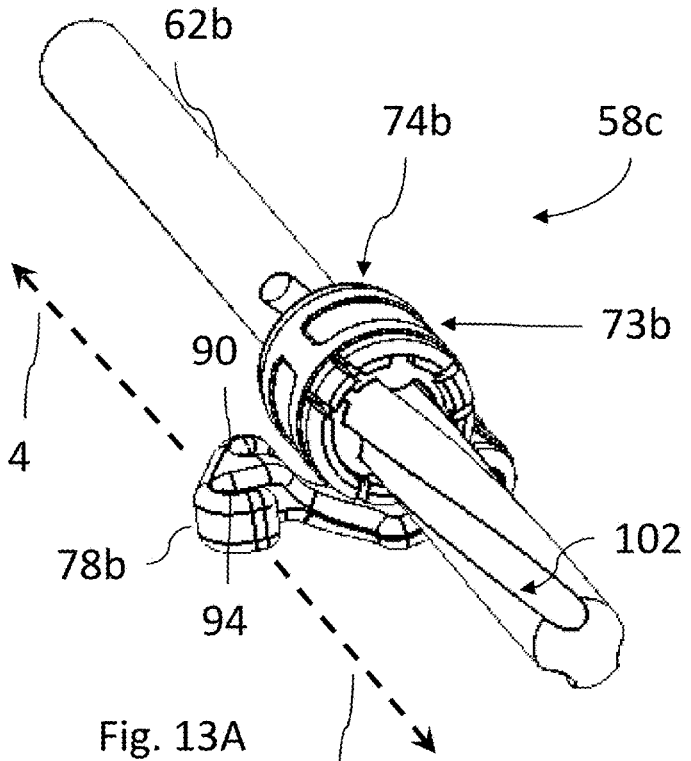
FIG. 13A is a rear isometric view of the archery cord manager of FIG. 10A.
Figure 13B:
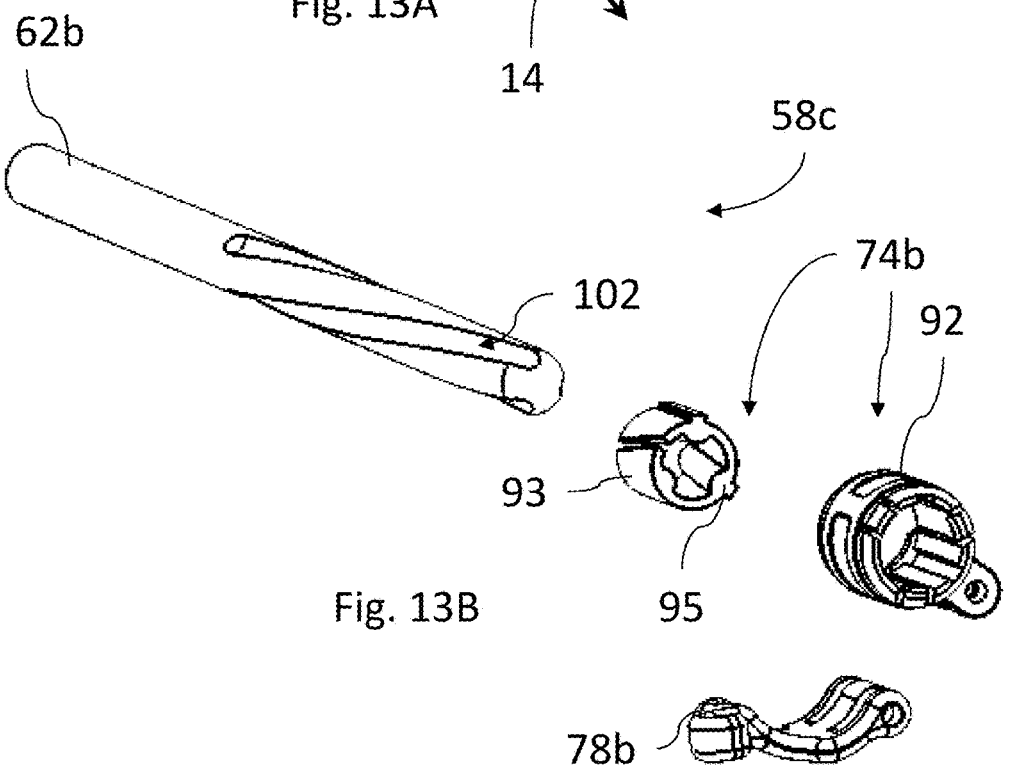
FIG. 13B is an exploded isometric view of the archery cord manager of FIG. 13A.

When the draw cord 46 is in the undrawn condition A, as illustrated by FIGS. 10A-10B and 12A, the body coupler 74*b* is in an outward position O on the body 62*b*, near the riser 22, and the archery cord manager 58*b* holds the supplemental cord set 42 away from the draw cord 46 and the draw cord plane 50. While holding the supplemental cord set 42, the cord engager 78*b* applies an outward lateral clearance force 7 (FIG. 1B), which exceeds the inward lateral bow force 8 (FIG. 1B).

In an example, the outward position O of the body coupler 90 is located so that the joint 98 is at the "4 o'clock" position (FIG. 10B) at a first X distance from the riser 22. It should be appreciated that the archery cord manager 58*b* can have various structures or components operable to produce securing forces to maintain the body coupler 74*b* in the outward position O despite the inward lateral bow force 8. For example, the inner surface of the body coupler 74*b* can include a frictional interface for the body 62*b* to generate a securing force of frictional resistance with respect to the body 62*b*. The frictional resistance can resist the translational movement of the body coupler 74*b* relative to the body 62*b*. Also, the frictional resistance can resist rotational movement of the body coupler 74*b* relative to the body 62*b*.

Figure 11A:
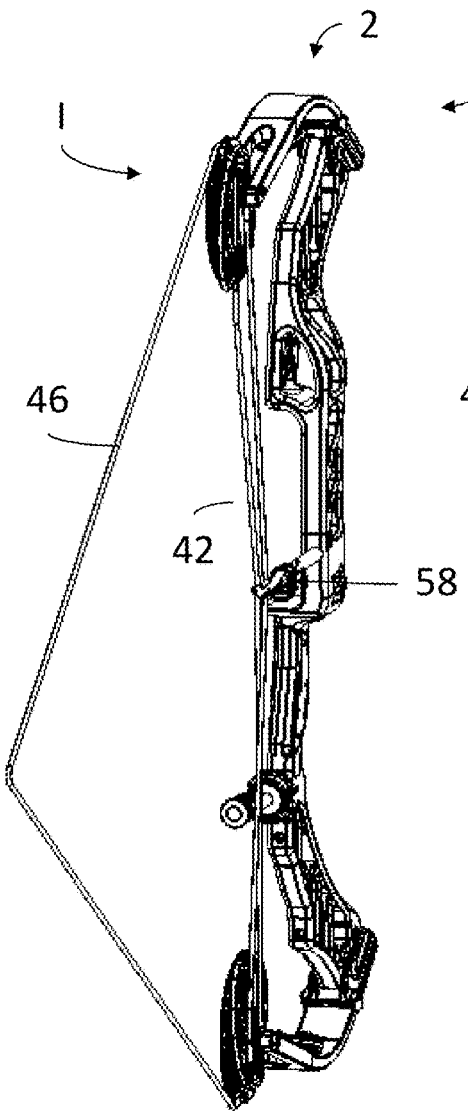
FIG. 11A is an isometric view of the archery cord manager of FIG. 10A mounted on the archery bow in the drawn condition.
Figure 11B:
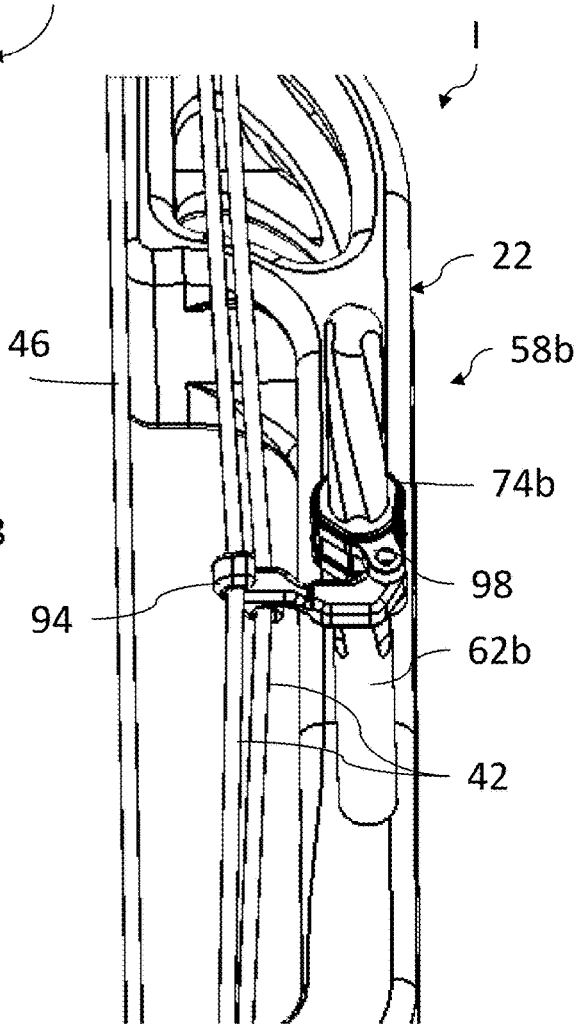
FIG. 11B is an enlarged rear view of the archery cord manager of FIG. 11A mounted on the archery bow.

As the draw cord 46 is moved to the drawn condition B, illustrated by FIGS. 11A-11B and 12B, the supplemental cord set 42 experiences, in an embodiment: (a) the rearward force 5 (FIG. 1B); and (b) the inward lateral bow force 8 (FIG. 1B), which is transferred to the cord engager 78*b* and the body coupler 74*b*. Eventually, the combination or sum of the rearward force 5 and inward lateral bow force 8 exceeds or overcomes the outward lateral clearance force 7 and the securing forces of the body coupler 74*b*. In response, the body coupler 74*b* translates along the body 62*b* in the rearward direction 14 to an inward position I, and the body coupler 74*b* simultaneously rotates around the body 62*b* until the cord engager 78*b* is near or within the draw cord plane 50. In the example shown in FIG. 11B, the inward position I of the cord engager 78*b* is located so that the joint 98 is at the "5 o'clock" position. When the draw cord 46 is released for returning to the undrawn condition A from the drawn condition B, the inward lateral bow force 8 decreases, and the forward force 3 (imparted by the rotating rotors 34, 38) urges the supplemental cord set 42 in the forward direction 4. When the supplemental cord set 42 moves forward to the position between the rotors 34, 38, the cord engager 78*b* moves outward, away from the draw cord plane 50, the securing forces of the body coupler 74*b* secure the body coupler 74*b* in an outward position O relative to the body 62*b*, and the cord engager 78*b* pulls the supplemental cord set 42, applying the outward lateral clearance force 7 to the supplemental cord set 42.

In an embodiment illustrated in FIGS. 12A-13B, the body 62*b* of archery cord managers 58*b* and 58*c* is a splined shaft having a plurality of spiral tracks defined by at least one or a plurality of spiral slots or grooves 102 etched, cut or formed on the surface of the body 62*b* in a spiral along its length. In this embodiment, the body coupler 74*b* is a two-part member including a sleeve member 92 to which the cord engager 78*b* is coupled and an insert 93. The insert 93 includes a plurality of inwardly-extending projectiles or protrusions 95 configured to engage the body 62*b* and insert into the spiral grooves 102. As shown, the protrusions 95 extend axially along axes parallel to the axes of the grooves 102. This guides and facilitates the dual translational and rotational movements of the body coupler 74*b* relative to the body 62*b*. In the example shown in FIG. 13A, because of the winding orientation of the spiral grooves 102, a rearward force 5 on the cord engager 78*b* would cause the body coupler 74*b* to translate rearward 14 (FIG. 1A) and to rotate clockwise, moving the cord engager 78*b* closer to the draw cord plane 50. Also, a forward force 3 on the cord engager 78*b* would cause the body coupler 74*b* to translate forward 4 (FIG. 1A) and to rotate counterclockwise, moving the cord engager 78*b* away from the draw cord plane 50.

Figure 14A:
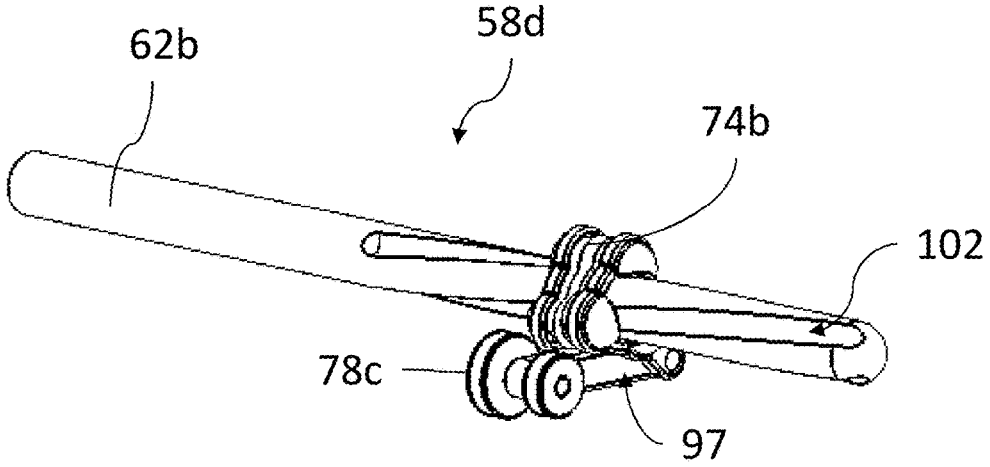
FIG. 14A is a side isometric view of another embodiment of an archery cord manager.
Figure 14B:
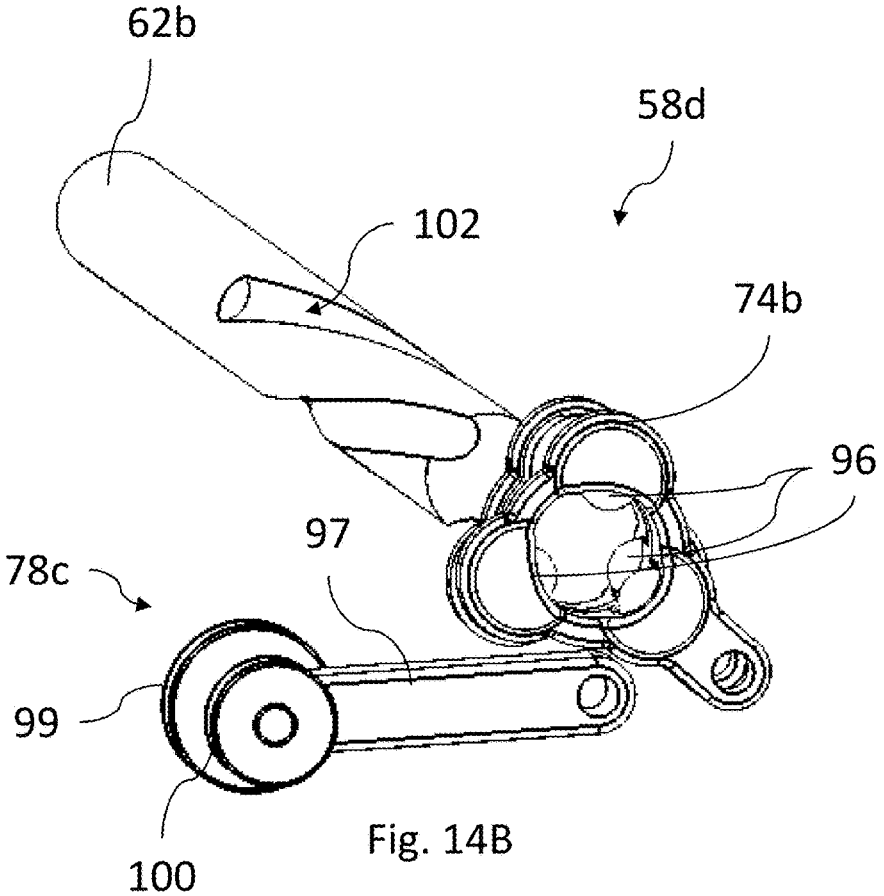
FIG. 14B is a rear isometric view of the archery cord manager of FIG. 14A.

In another embodiment, illustrated in FIGS. 14A-14B, an archery cord manager 58*d* includes the body 62*b*, the body coupler 74*b* which receives the body 62*b*, and a cord engager 78*c* pivotally coupled to the body 62*b*. In this embodiment, the cord engager 78*c* includes: (a) an arm 97; and (b) a plurality of spaced-part guides, including: (i) a first guide wheel 99 rotatably coupled to the arm 97; and (ii) a second guide wheel 100 rotatably coupled to the arm 97. In an embodiment, in operation, the supplemental cord set 42 is located between the guide wheels 99, 100 while the cord engager 78*c* varies the position of the supplemental cord set 42 as described above. In another embodiment, each supplemental cord segment 43, 44 of the supplemental cord set 42 fits within a groove defined by a guide wheel 99, 100. Also, in this embodiment, the body coupler 74*b* includes a plurality of ball bearing members 96 (FIG. 14B) extending radially inward. The ball bearing members 96 rest on the surface of the body 62*b*, within the applicable spiral grooves 102. This facilitates the dual translational and rotational movements of the body coupler 74*b* along the body 62*b*, following the spiral groves 102.

Figure 15A:
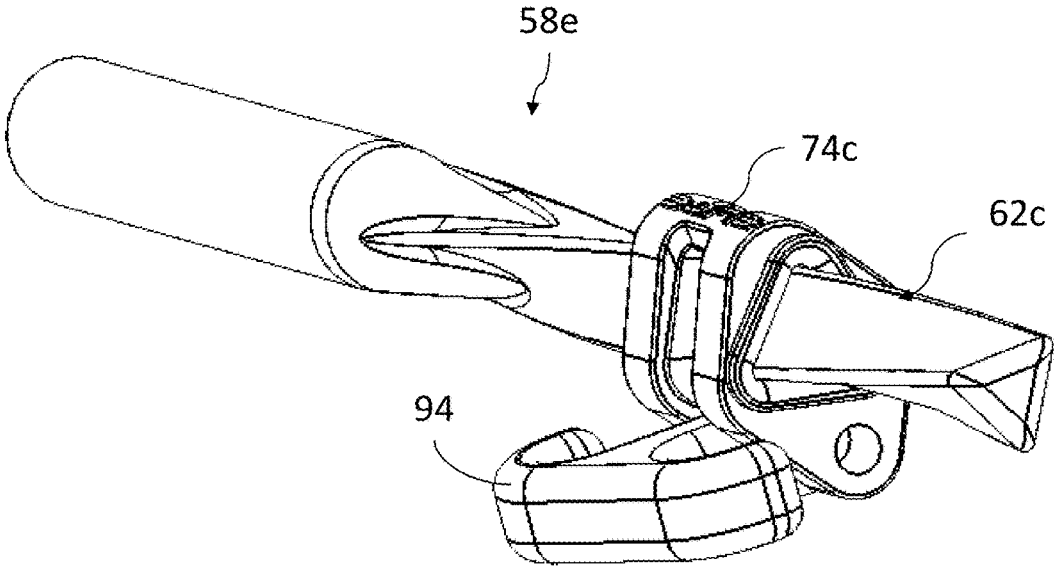
FIG. 15A is a rear isometric view of another embodiment of an archery cord manager.
Figure 15B:
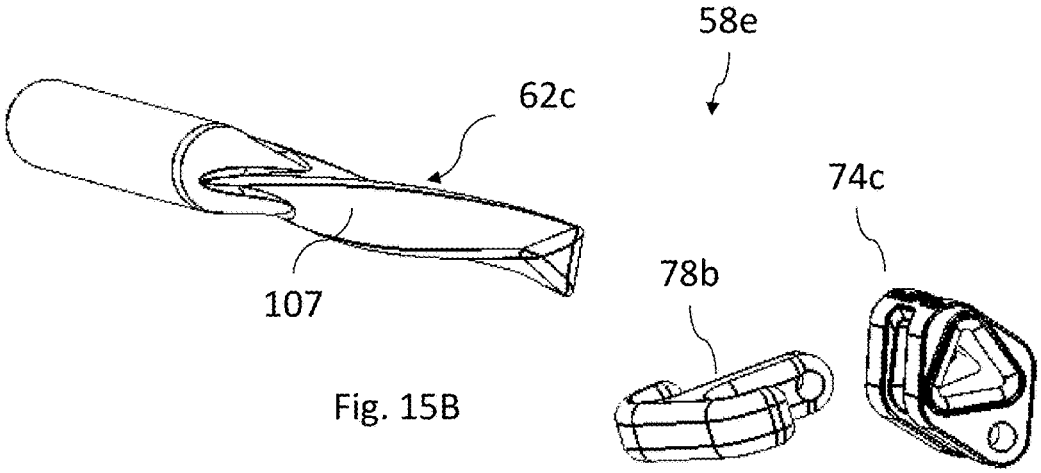
FIG. 15B is an exploded isometric view of the archery cord manager of FIG. 15A.

In another embodiment, illustrated in FIGS. 15A-15B, an archery cord manager 58*e* includes a twisted body 62*c* and a body coupler 74*c*. The twisted body 62*c* includes a plurality of sides arranged in a twisted configuration, such as the twisted sides 107 of a twisted, triangular shaft, as shown. In this embodiment, the body coupler 74*c* has an interior shape that corresponds to, receives and mates with, the exterior shape of the twisted body 62*c*. In the embodiment shown, the body coupler 74*c* has a triangular interior cross-section. In addition, the interior surfaces of the body coupler 74*c* twist in a manner corresponding to the twist of the twisted body 62*c*. In the example shown in FIG. 15A, because of the twisted orientation of the twisted body 62*c*, a rearward force 5 (FIG. 1B) on the cord engager 78*b* would cause the body coupler 74*c* to both translate rearward 14 (FIG. 1A) and rotate clockwise, moving the cord engager 78*b* closer to the draw cord plane 50. Also, a forward force 3 (FIG. 1B) on the cord engager 78*b* would cause the body coupler 74*c* to both translate forward 4 (FIG. 1A) and rotate counterclockwise, moving the cord engager 78*b* away from the draw cord plane 50.

Figure 16A:
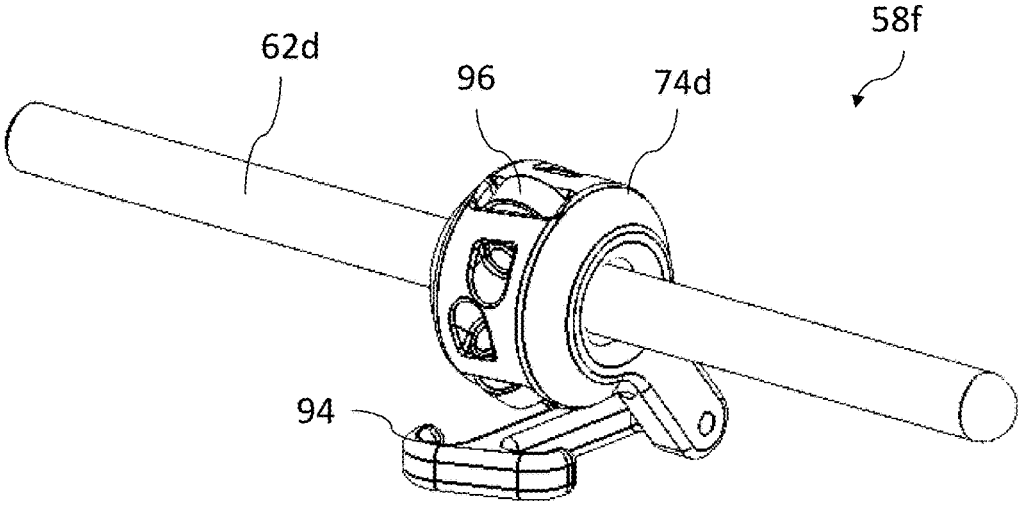
FIG. 16A is a side isometric view of yet another embodiment of an archery cord manager.
Figure 16B:
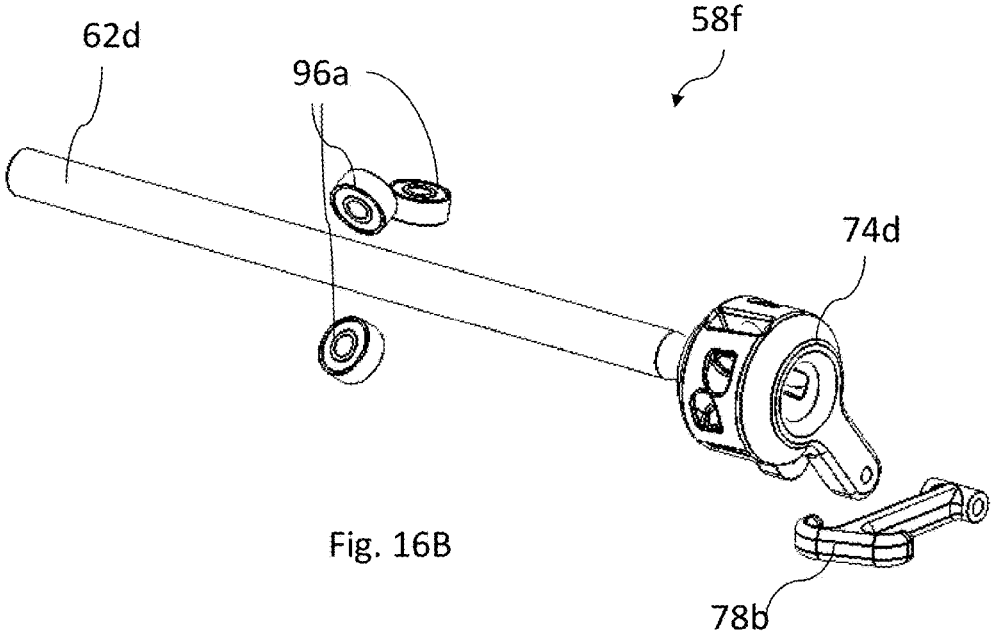
FIG. 16B is an exploded isometric view of the archery cord manager of FIG. 16A.
Figure 16C:
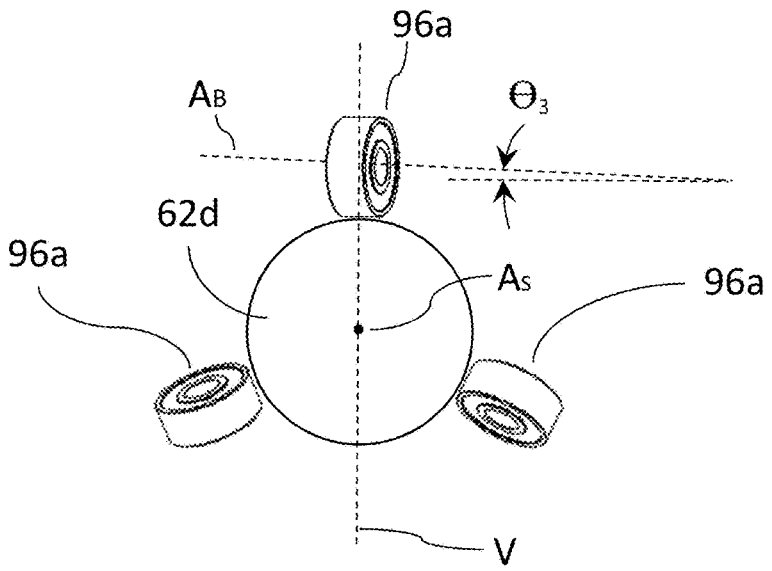
FIG. 16C is a rear view illustrating the interaction of the body and body engager bearing members of the archery cord manager of FIG. 16A.
Figure 16D:
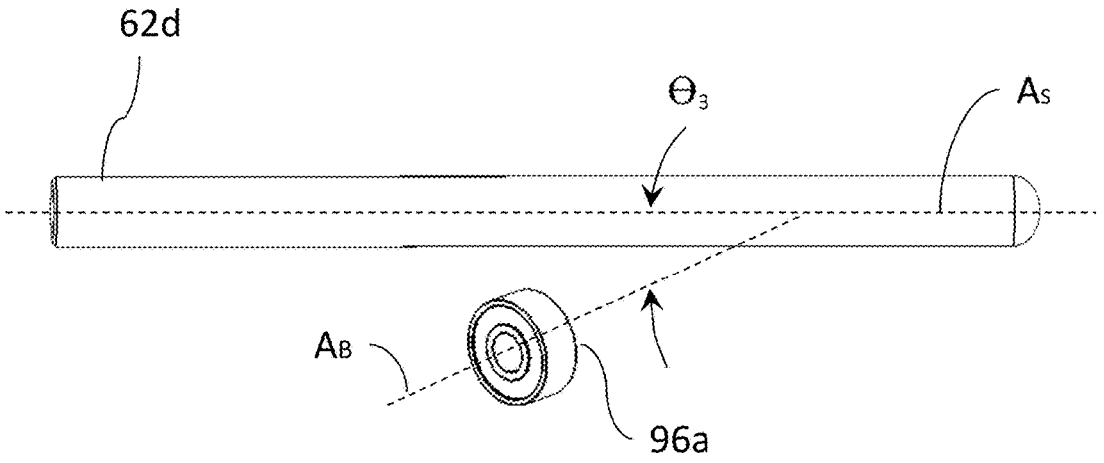
FIG. 16D is a side view illustrating the positioning of a bearing member and the body of the archery cord manager of FIG. 16C.

In another embodiment illustrated in FIGS. 16A-16D, an archery cord manager 58*f* includes a body 62*d*, a body coupler 74*d* which encircles the body 62*d*, and the cord engager 78*b* pivotally coupled to the body coupler 74*d*. The body 62*d* is a rod, shaft, tube or other elongated arm having a uniform surface. In this embodiment, the body coupler 74*d* includes a plurality of cylindrical bearing members 96*a* (e.g., roller bearings) extending radially inward toward the body 62*d*. The bearing members 96*a* rest on the surface of the body 62*d* and facilitate movement of the body coupler 74*d* along the body 62*b*. As illustrated by FIGS. 16A and 16C, body coupler 74*d* includes a plurality of shafts (not shown), and each such shaft rotatably couples one of the bearing members 96*a* to the body coupler 74*d*. Each bearing member 96*a* is oriented at a pitch or angle relative to the body 62*d*. In particular, as illustrated by FIGS. 16C-16D, each bearing member 96*a* is oriented such that the bearing member axis $A_B$ is neither parallel nor perpendicular to the body axis $A_S$, and the bearing member axis $A_B$ forms an angle $\theta_3$ with the body axis $A_S$. In an embodiment, the body axis $A_S$ extends in a vertical plane V, and the bearing member axis $A_B$ strikes vertical plane V at a non-normal angle (e.g., an angle other than ninety degrees). This orientation of the bearing members 96*a* relative to the body 62*d* facilitates lateral rotation of the body coupler 74*d* and the cord engager 78*b* around the body 62*d*, causing the body coupler 74*d* to travel translationally and rotationally or in a spiral fashion or otherwise circling the body 62*d*. In addition, the rearward force 5 applied to the cord engager 78*b* by the draw cord 46 facilitates a movement of the body coupler 74*d* in the rearward direction 14 along the body 62*d* as the draw cord 46 moves to the drawn condition B. Thus, as the draw cord 46 moves to the drawn condition B, the body coupler 74*d* and the cord engager 78*b* experience a simultaneous lateral rotation about, and rearward movement along, the body 62*d*.

In another embodiment (not shown), the archery cord manager 58*f* includes a position controller operatively coupled to the body 62*d* or the body coupler 74*d*. The position controller can be mechanical or electromechanical and can include one or more springs, actuators, magnetic devices or motors, among other components. In the undrawn condition A, the cord engager 78*b* is oriented to keep the supplemental cord set 42 apart from the draw cord plane 50 to provide clearance for the arrow 18. In the drawn condition B, the cord engager 78*b* moves so that the supplemental cord set 42 is in a position close to, or within, the draw cord plane 50.

Figure 17:
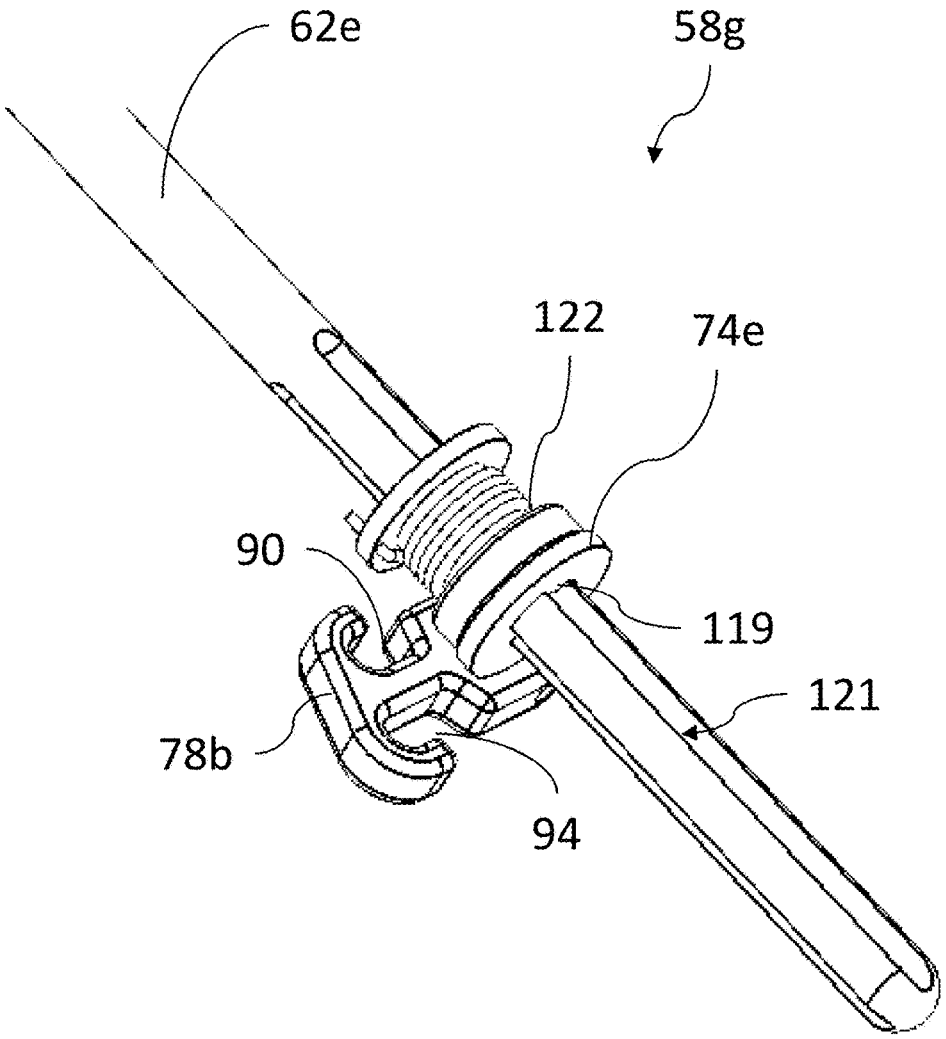
FIG. 17 is a top isometric view of another embodiment of an archery cord manager.
Figure 18A:
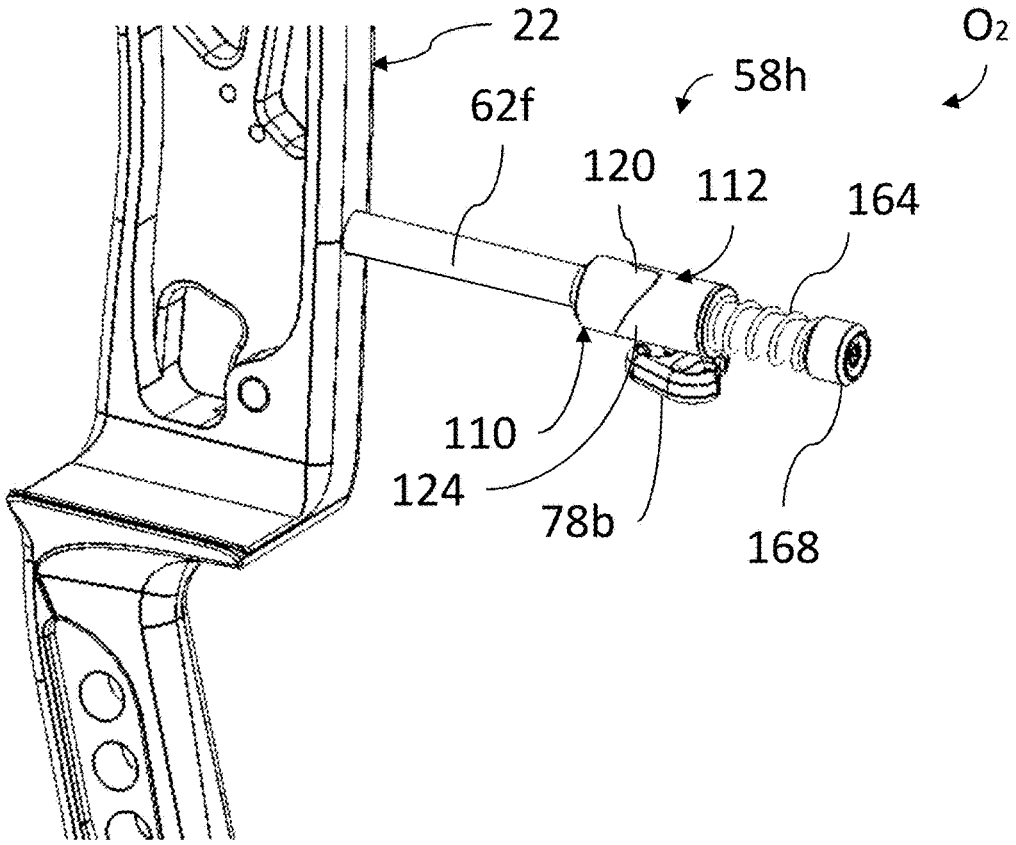
FIG. 18A is an isometric view of another embodiment of an archery cord manager mounted on a riser of an archery bow in the undrawn condition, illustrating the cord engager in the outward position.
Figure 18B:
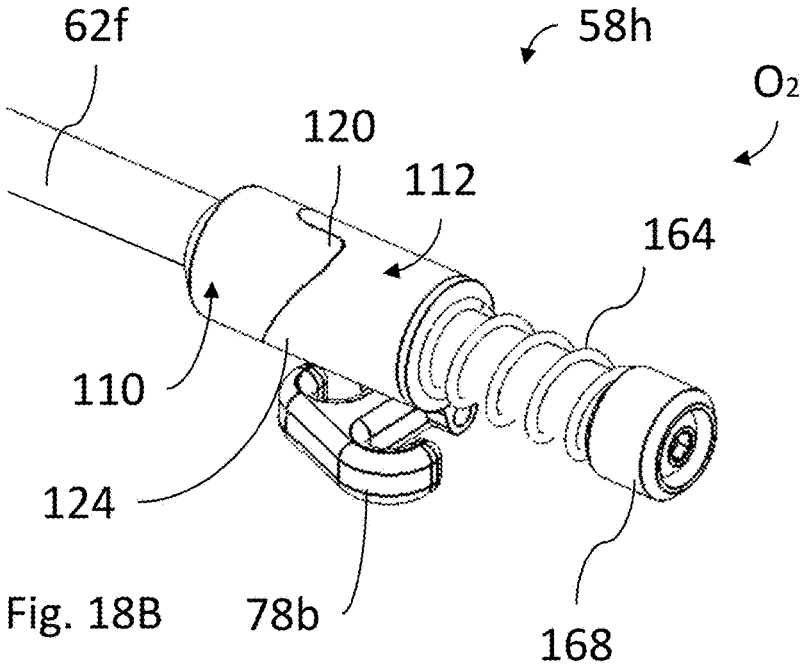
FIG. 18B is an enlarged view of the archery cord manager of FIG. 18A in the undrawn condition, illustrating the cord engager in the outward position.

In another embodiment illustrated in FIG. 17, an archery cord manager 58*g* includes a body 62*e*, a body coupler 74*e* moveably coupled to the body 62*e* and the cord engager 78*b* pivotally coupled to the body coupler 74*e*. The body 62*e* includes a splined shaft having a straight track defining a plurality of parallel, straight slots or grooves 121 along its length. In this embodiment, the body coupler 74*e* has a plurality of inwardly-extending protrusions 119 that rest in the straight grooves 121. In this embodiment, the archery cord manager 58*g* includes a position controller 122 operatively coupled to the body coupler 74*e*. The position controller 122 can be mechanical or electromechanical and can include one or more springs, actuators, magnetic devices or motors, among other components. In the undrawn condition A, the position controller 122 orients the cord engager 78*b* to keep the supplemental cord set 42 apart from the draw cord plane 50 to provide clearance for the arrow 18. In the drawn condition B, the position controller 122 enables the cord engager 78*b* to move so that the supplemental cord set 42 is in a position close to, or within, the draw cord plane 50.

Figure 20A:
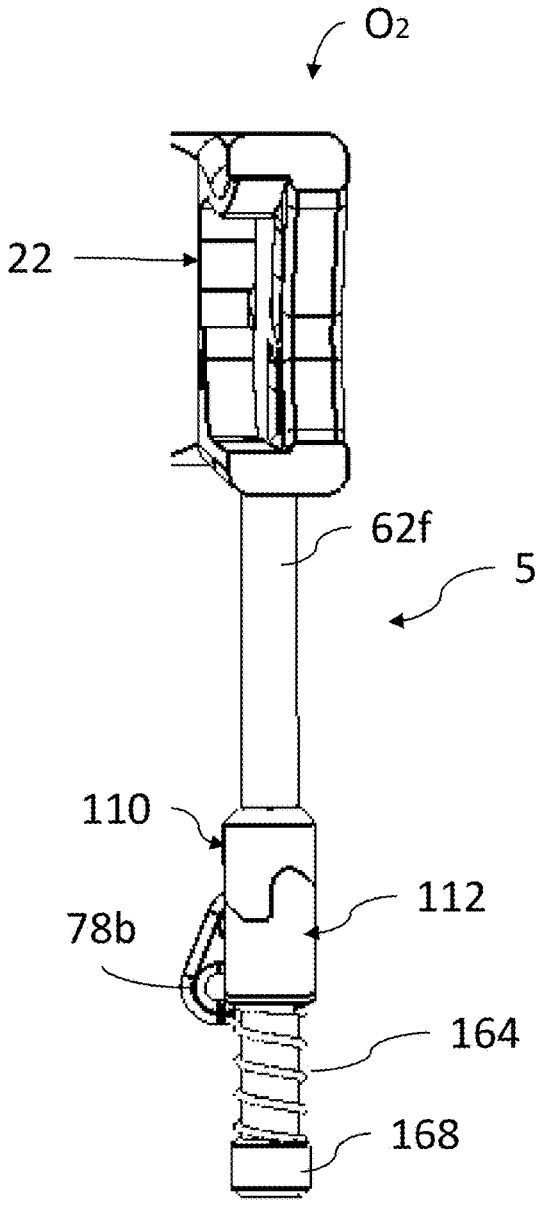
FIG. 20A is a top view of the archery cord manager of FIG. 18A mounted on the riser in the undrawn condition, illustrating the cord engager in the outward position.
Figure 20B:
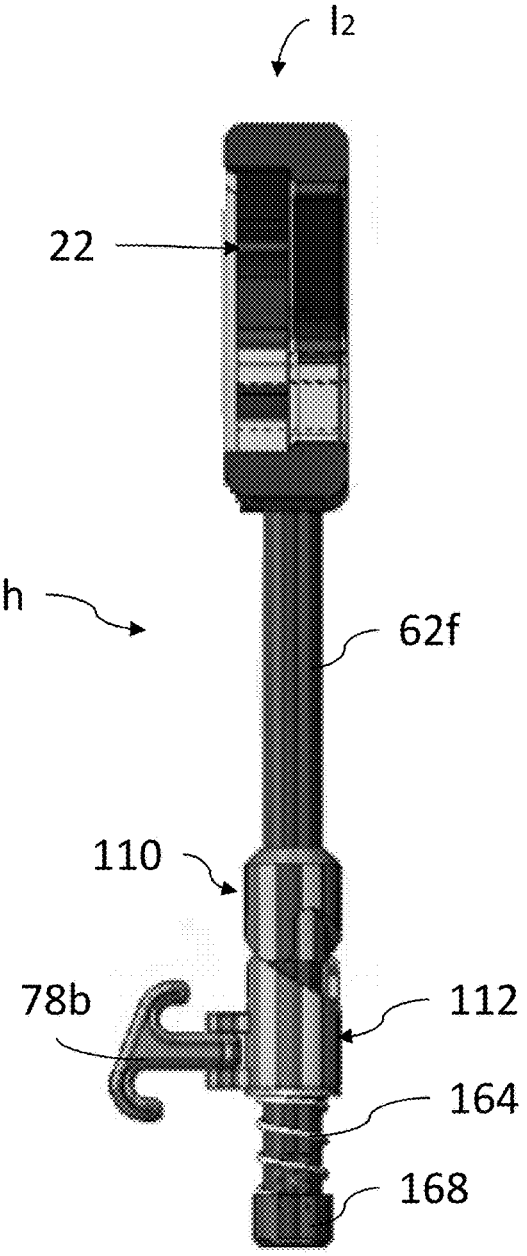
FIG. 20B is a top view of the archery cord manager of FIG. 19A mounted on the riser in the drawn condition, illustrating the cord engager in the inward position.
Figure 21:
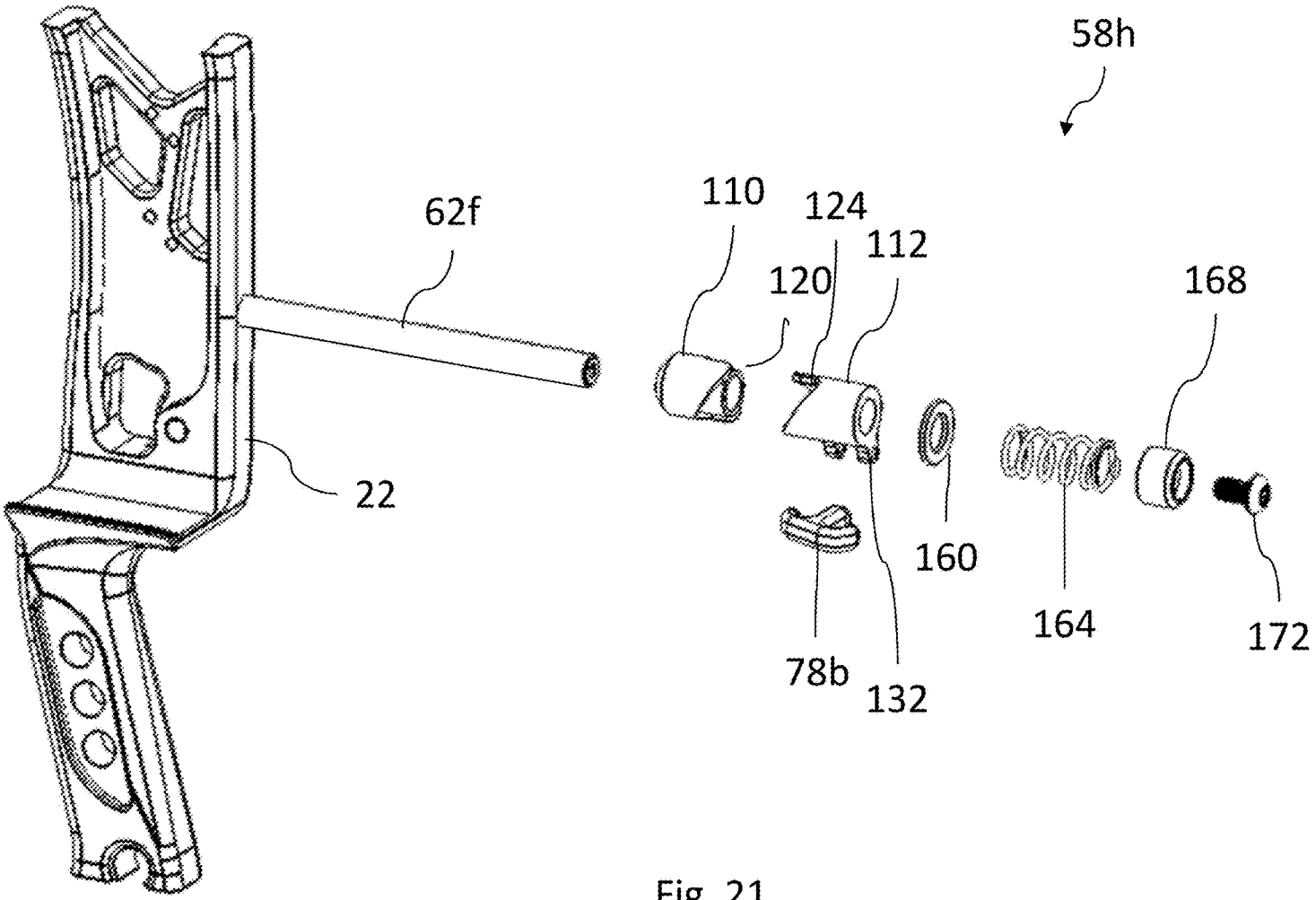
FIG. 21 is an exploded isometric view of the archery cord manager of FIG. 18A.
Figure 22:
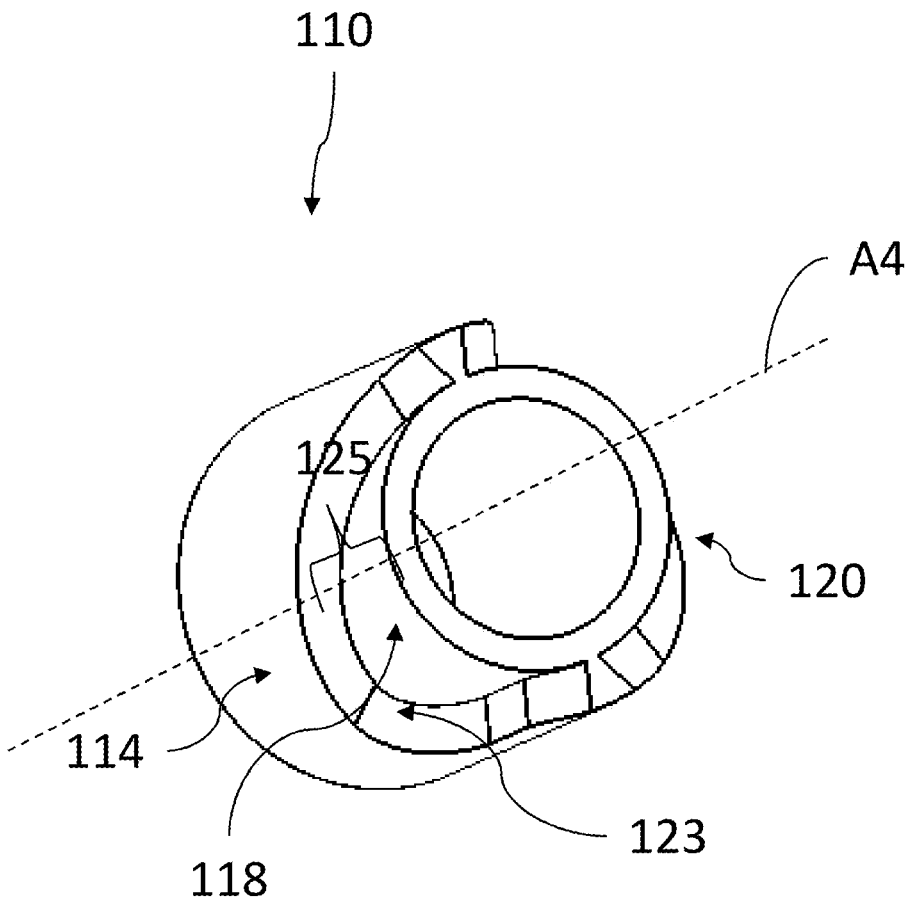
FIG. 22 is an isometric view of an embodiment of a first body engager of the archery cord manager of FIG. 18A.

Referring to FIGS. 18A-24C, another embodiment of an archery cord manager 58*h* is illustrated. In this embodiment, the archery cord manager 58*h* includes: (a) a mounting post or body 62*f*; (b) a first body engager 110 serving a rotor function, which receives the body 62*f*; and (c) a second body engager 112 serving a cam-follower function, which also receives the body 62*f*. As illustrated by FIG. 22, the first body engager 110 has a substantially tubular or cylindrical, hollow shape. The outer wall 114 of the first body engager 110 is sculpted or shaped to form: (a) an arc-shaped or curvilinear rotor surface or guide wall 123; and (b) a lowered floor 118 extending from a first end 120 along the outer wall 114 parallel to the longitudinal axis A4 of the first body engager 110 and extending partway through the outer wall 114. The cam surface or guide wall 123 and floor 118 define a position adjustment space 125, as described below.

Figure 23A:
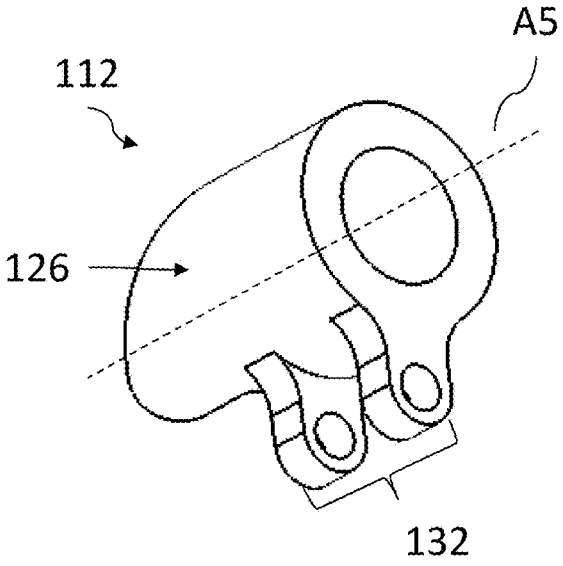
FIG. 23A is a front isometric view of the second body engager of the archery cord manager of FIG. 18A.
Figure 23B:
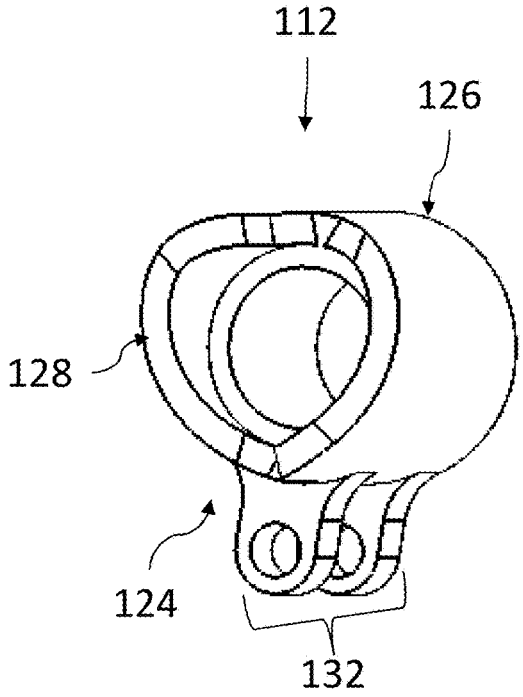
FIG. 23B is a rear isometric view of the second body engager of FIG. 23A.
Figure 23C:
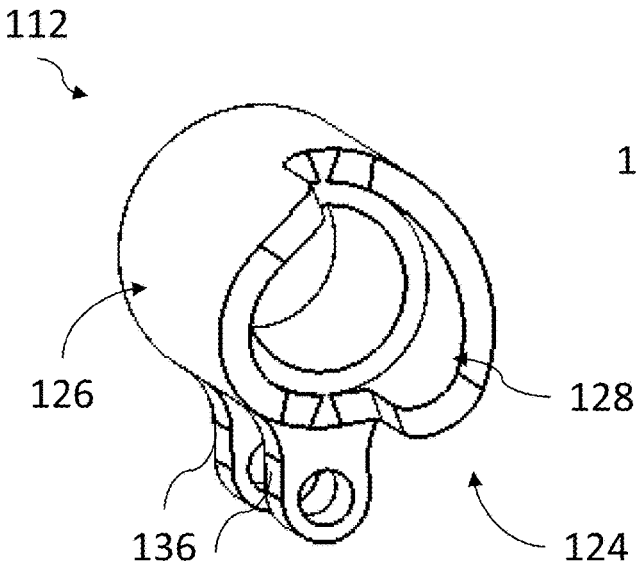
FIG. 23C is another rear isometric view of the second body engager of FIG. 23A.

As illustrated by FIGS. 23A-23C, the second body engager 112 also has a substantially tubular or cylindrical, hollow shape. A first end 124 of the outer wall 126 of the second body engager 112 has at least one rotor-follower or extension portion 128, having a curvilinear or arc shape, extending therefrom along the longitudinal axis A5 of the second body engager 112. The extension portion 128 is configured to mate with the guide wall 123 and floor 118 of the first body engager 110. The extension portion 128 extends along the outer wall 126 parallel to the longitudinal axis A2. Also, the extension portion 128 fits and inserts into the position adjustment space 125 of first body engager 110 while physically interfacing with the rotor surface or guide wall 123 and floor 118.

In addition, a coupler or coupling surface 132 extends from the outer wall 126. The coupling surface 132 defines a pivot opening extending substantially parallel to the longitudinal axis A5. In the illustrated example, the coupling surface 132 is formed by two parallel extensions or legs 136 (FIG. 23C) extending from the outer wall 126.

Figure 24A:
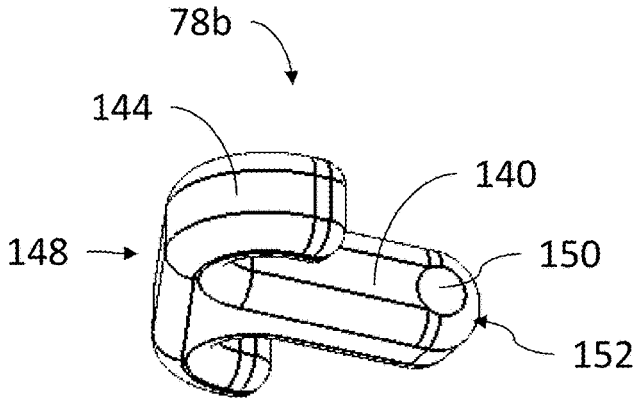
FIG. 24A is an isometric view of an embodiment of a cord engager or cord holder of the archery cord manager of FIG. 18A.
Figure 24B:
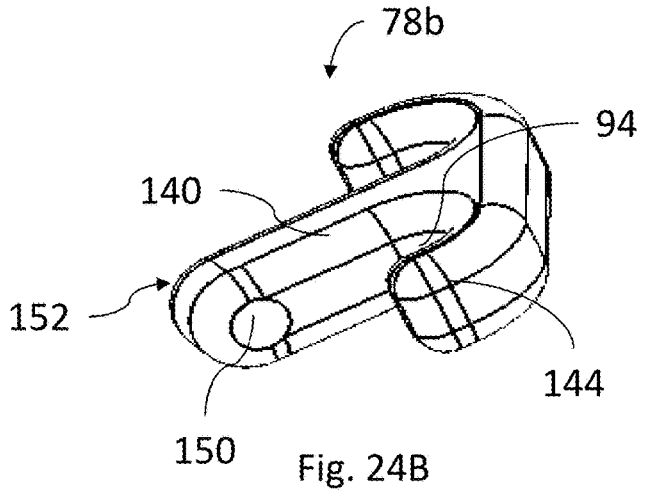
FIG. 24B is another isometric view of the cord engager or cord holder of the archery cord manager of FIG. 18A.
Figure 24C:
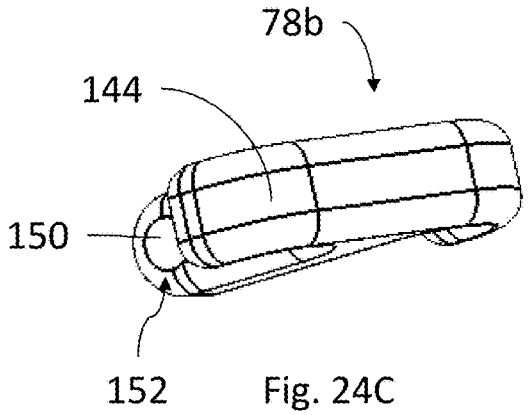
FIG. 24C is yet another isometric view of the cord engager or cord holder of the archery cord manager of FIG. 18A.

Referring to FIGS. 24A-24B, the archery cord manager 58*f* also includes the cord engager 78*b*. As described above, the cord engager 78*b* can have any suitable shape. In the embodiment illustrated by FIGS. 21A-21C, the cord engager 78*b* has a stem 140 having a bottom end 148. Also, the cord engager 78*b* has a T-shaped, double hook 144 extending from the bottom end 148, giving the cord engager 78*b* an anchor shape. The top end 152 of the body engager 110, 112 defines a pivot opening or pivot aperture 150 configured to receive a pin or other suitable pivot member. The double hook 144 defines the spaced-apart cord slots 90, 94 described above.

Referring back to FIG. 21, the body 62*f* of the archery cord manager 58*h* is coupled to and extends from the riser 22. The first body engager 110 is positioned on the body 62*f* such that the body 62*f* extends through the hollow interior of the first body engager 110. In an embodiment, the first body engager 110 is integral with the body 62*f*. In another embodiment, the first body engager 110 is removably coupled to the body 62*f*. The second body engager 112 is positioned on the body 62*f*, next to the first body engager 110 such that the body 62*f* extends through the hollow interior of the second body engager 112. When assembled, the first end 120 of the first body engager 110 is adjacent to the first end 124 of the second body engager 112. The cord engager 78*b* is pivotally coupled to the coupling surface 132 of the second body engager 112. In this example, the cord engager 78*b* is pivotally pinned to the legs 136 of the coupling surface 132.

In an embodiment, the first body engager 110 is fixedly attached to the body 62*f*. The first body engager 110 is immovably secured to the body 62*f* through a fastener, press-fit connection, set screw, adhesive or other suitable fastening approach. In another embodiment, the first body engager 110 is not separate from the body 62*f*; instead, the structure of the body 62*f* incorporates the geometry of the first body engager 110 as a one-piece, unitary configuration. As described below, the second body engager 112 is moveably coupled to the body 62*f* for a rotor-based cooperation with the first body engager 110.

As illustrated in FIG. 21, the archery cord manager 58*h* also includes: (a) a first stop member 160, such as a washer, positioned on the body 62*f* adjacent to the second body engager 112; (b) a biasing member 164, such as a spring, positioned on the body 62*f* adjacent to the stop member 160; (c) a second stop member 168, such as a tubular collar, positioned on the body 62*f* adjacent to the biasing member 164; and (d) a fastener 172, such as a screw or bolt, installed at the end of the body 62*f* to hold and secure the foregoing components on the body 62*f*.

Referring particularly to FIGS. 18A-19B, in the undrawn condition A (FIGS. 18A-18B), the first end 120 of the first body engager 110 contacts the first end 124 of the second body engager 112 so that the extension portion 128 of the second body engager 112 is received in the position adjustment space 125 (FIG. 22) of the first body engager 110. The biasing member 164 exerts an axial force on the second body engager 112 to bias the second body engager 112 against the first body engager 110 in the undrawn condition A of the bow 2.

In this arrangement, the extension portion 128 of the second body engager 112 is engaged and mated with the guide wall 123 and floor 118 (FIG. 22) of the first body engager 110. Also, the cord engager 78*b* is positioned so as to hold the supplemental cord set 42 (FIG. 2A) away from the draw cord plane (FIG. 2A). In doing so, the cord engager 78*b* applies a lateral clearance force 7 (FIG. 1B) to the supplemental cord set 42. As described above, this keeps the supplemental cord set 42 away from the path of the arrow 18 in the undrawn condition A of the bow 2.

Figure 19A:
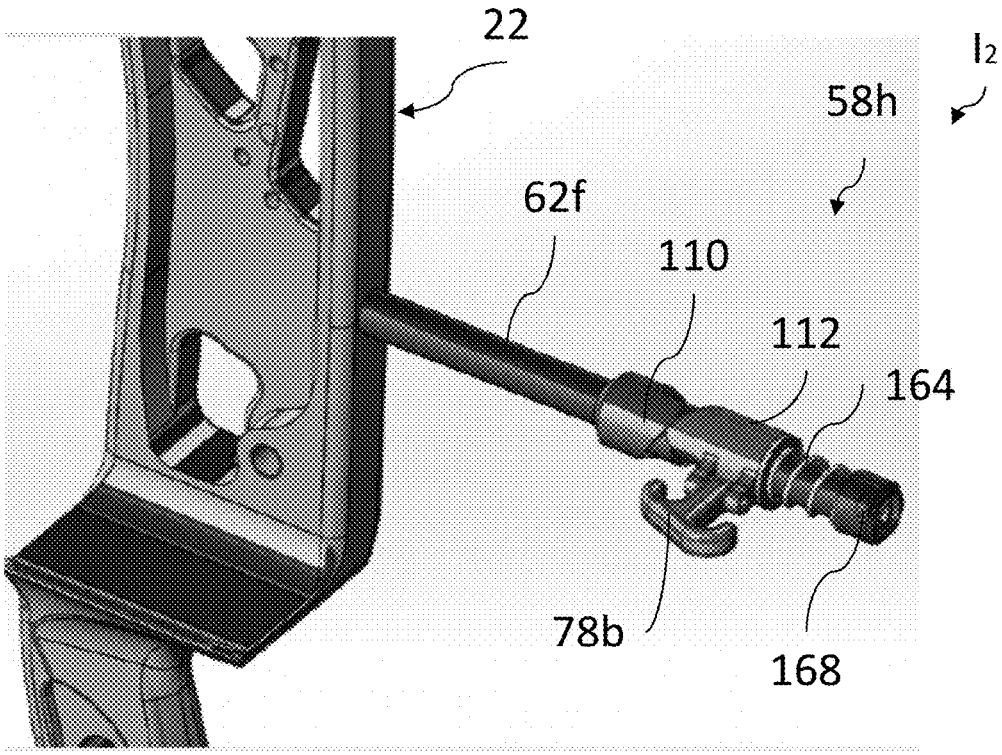
FIG. 19A is an isometric view of the archery cord manager of FIG. 18A mounted on the riser in the drawn condition, illustrating the cord engager in the inward position.
Figure 19B:
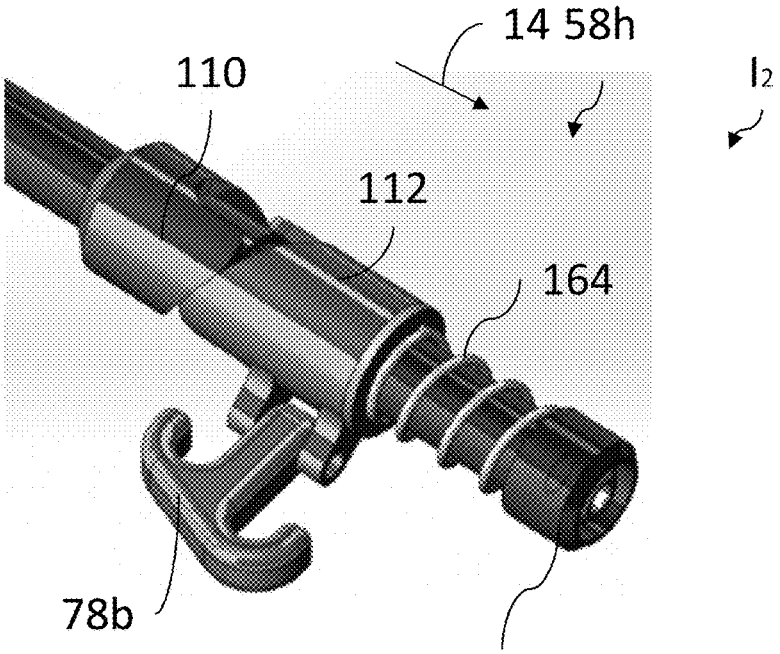
FIG. 19B is an enlarged view of the archery cord manager of FIG. 19A in the drawn condition, illustrating the cord engager in the inward position.

Referring to FIGS. 19A-19B, as the draw cord 46 (FIG. 2B) is moved to a drawn condition B, the supplemental cord set 42 experiences: (a) the rearward force 5 (FIG. 1B); and (b) the inward lateral bow force 8 (FIG. 1B), which is transferred to the cord engager 78*b* and to the second body engager 112. Eventually, the combination or sum of the rearward force 5 and inward lateral bow force 8 exceeds or overcomes the outward lateral clearance force 7 (FIG. 1B) and the spring force of the biasing member 164. In response, the second body engager 112 translates along the body 62*f* in the rearward direction 14, and the second body engager 112 simultaneously rotates around the body 62*f* until the cord engager 78*b* moves the supplemental cord set 42 to be near or within the draw cord plane 50.

As illustrated in FIGS. 20A-20B, during the transition from the undrawn condition A to the drawn condition B, the extension portion 128 (FIG. 23B) of the second body engager 112 slides along the rotor surface or guide wall 123 and floor 118 (FIG. 22) of the first body engager 110. Because of the curvilinear shape of the rotor surface or guide wall 123, the first body engager 110 pushes the second body engager 112 rearward 14 (FIG. 1A), overcoming the force of the spring or biasing member 164. At the same time, the first body engager 110 causes the second body engager 112 to rotate. In the example shown in FIGS. 19A-19B, the rotation occurs clockwise, causing the cord engager 78*b* to move laterally from its outward position $O_2$ (FIG. 20A) to its inward position $I_2$ (FIG. 20B). In the inward position $I_2$, the cord engager 78*b* is positioned to hold the supplemental cord set 42 close to, or within the draw cord plane 50 (FIG. 1C). In this inward position $I_2$, the extension portion 128 of the second body engager 112 has rotated so as to be at least partially out of contact with the guide wall 123 of the first body engager 110 and into contact with the non-cutaway portion of the first body engager 110.

When the draw cord 46 is released for returning to the undrawn condition A from the drawn condition B, the inward lateral bow force 7 (FIG. 1B) decreases, and the forward force 3 imparted by the rotating rotors 34, 38 (FIG. 1B) urges the supplemental cord set 42 in the forward direction 4 (FIG. 1A). The sum of these forces 7, 3 and the spring force of the biasing member 164 causes the second body engager 112 to: (a) translate axially forward 4 relative to the body 62*f*; and (b) simultaneously rotate relative to the body 62*f*. In the example shown, this rotation occurs in the counterclockwise direction. By the time the supplemental cord set 42 moves forward to the position between the rotors 34, 38 in the undrawn condition A, the cord engager 78*b* moves outward, away from the draw cord plane 50, and the cord engager 78*b* pulls the supplemental cord set 42, applying the outward lateral clearance force 7 to the supplemental cord set 42. In this undrawn condition A, the extension portion 128 of the second body engager 112 is fully received in the position adjustment space 125 of the first body engager 110, as show in FIG. 20A.

The archery cord managers 58, 58*a*, 58*b*, 58*c*, 58*d*, 58*e*, 58*f*, 58*g* and 58*h*, in an embodiment, are each configured to hold the supplemental cord set 42 away from the draw cord plane 50 in the undrawn condition A of the bow 2 and enable the supplemental cord set 42 to move toward the draw cord plane 50 as the bow 2 is transitioned to the drawn condition B. In the undrawn condition A, an outward lateral clearance force 7 pulls the supplemental cord set 42 away from the path of the arrow 18 to avoid interference with the arrow 18. In the drawn condition B, there is a zero magnitude or relatively low magnitude of the outward lateral clearance force 7 or the sum of lateral forces acting on the supplemental cord set 42. Therefore, in an example, the only sum of lateral forces on the supplemental cord set 42 in the drawn condition B is a relatively low force imparted by the arrow 18, which may be in contact with the supplemental cord set 42. The relatively small diameter of the arrow 18 separates the supplemental cord set 42 from the draw cord 46. This results in the relatively low, lateral arrow force on the supplemental cord set 42. When the bow 2 transitions to the drawn condition B with no arrow 18 loaded in the bow 2, there is a zero magnitude or relatively low magnitude of the outward lateral clearance force 7 acting on the supplemental cord set 42, and there is no lateral arrow force acting on the supplemental cord set 42. This dynamic regulation of the lateral force sum on the supplemental cord set 42 reduces the length of time during which a substantial lateral force sum is experienced by the supplemental cord set 42. Consequently, this reduces the damaging, life-shortening and performance-hindering effects of lateral forces on the bow 2, its rotors 34, 38, riser 22 and other components. In addition, this enhances arrow flight and improves performance of the bow 2.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery cord manager comprising:

a first end configured to be coupled to a bow, wherein the bow comprises a draw cord moveable in a draw cord plane to launch a projectile along a shooting axis;

a second end;

a body between the first and second ends; and a cord engager supported by the body, wherein the cord engager is configured to engage a supplemental cord of the bow, wherein the supplemental cord is configured to increase a launching force of the bow;

wherein, when the cord engager is engaged with the supplemental cord, the cord engager is configured to move from an inward position to an outward position in response to the bow transitioning from a drawn condition to an undrawn condition, wherein, in the drawn condition, the draw cord is retracted, and wherein, in the undrawn condition, the draw cord is released.

2. The archery cord manager of claim 1, further comprising:

a first body engager and a second body engager coupled to the body, the first body engager and the second body engager comprising cooperating surfaces, the second body engager comprising the cord engager, wherein the second body engager is configured to move along the body relative to the first body engager, wherein movement along the body comprises:

a translational movement relative to the shooting axis; and a rotational movement causing the cord engager to move between the inward position and the outward position.

3. The archery cord manager of claim 1, further comprising a body engager moveably coupled to the body.

4. The archery cord manager of claim 3, wherein the body engager comprises a body coupler, and wherein the cord engager is pivotally coupled to the body coupler.

5. The archery cord manager of claim 3, wherein the body comprises a plurality of body segments extending along different body axes, wherein the body engager is configured to move along the body segments, and wherein, in response to movement of the body engager from one of the body segments to another one of the body segments, the cord engager is configured to move between the inward position and the outward position.

6. The archery cord manager of claim 3, wherein the body comprises a spiral track extending along a length of the body, wherein the body engager is moveably coupled to the spiral track, and wherein, in response to movement of the body engager along the spiral track, the cord engager is configured to move between the inward position and the outward position.

7. The archery cord manager of claim 6, wherein the body engager is configured to move along the spiral track relative to the shooting axis from a first position to a second position.

8. The archery cord manager of claim 3, wherein the body engager comprises at least two bearing members positioned in an opposing configuration and configured to rest on a surface of the body, the at least two bearing members configured to facilitate translational and rotational movement of the body engager along the body.

9. The archery cord manager of claim 8, wherein the body comprises a spiral track extending around and along a surface of the body and wherein the at least two bearing members are configured to rest within and travel along the spiral track.

10. The archery cord manager of claim 3, wherein the body comprises a uniform surface and wherein the body engager comprises a plurality of bearing members extending radially inward toward the body and configured to contact the surface of the body, each bearing member oriented such that an axis of each bearing member forms an angle other than 0 degrees and 90 degrees with an axis of the body, the plurality of bearing members configured to enable translational and rotational movement of the body engager along the body.

11. An archery cord manager comprising:

a first end configured to be coupled to a bow, wherein the bow comprises a draw cord moveable in a draw cord plane to launch a projectile along a shooting axis;

a second end;

a body between the first and second ends; and a body engager moveably coupled to the body, the body engager comprising a cord engager configured to engage a supplemental cord of the bow, wherein the body engager is configured to move along the body relative to the shooting axis, wherein the cord engager is configured to move from an inward position to an outward position in response to the bow being transitioned from a drawn condition to an undrawn condition, wherein the outward position is located further from the draw cord plane than the inward position, wherein, in the drawn condition, the draw cord is retracted, wherein, in the undrawn condition, the draw cord is released.

12. The archery cord manager of claim 11, wherein the body comprises a plurality of body segments extending along different body axes, wherein the body engager is configured to move along the body segments, and wherein, in response to movement of the body engager from one of the body segments to another one of the body segments, the cord engager is configured to move between the inward position and the outward position.

13. The archery cord manager of claim 11, wherein the body comprises a spiral track extending along a length of the body, the body engager is moveably coupled to the spiral track, and wherein, in response to movement of the body engager along the spiral track, the cord engager is configured to move between the inward position and the outward position.

14. The archery cord manager of claim 13, wherein the body engager is configured to move along the spiral track relative to the shooting axis from a first position to a second position.

15. The archery cord manager of claim 11, wherein:

the body engager comprises a first body engager and a second body engager coupled to the body, the first body engager and the second body engager comprising cooperating surfaces, the second body engager comprising the cord engager, wherein the second body engager is configured to move along the body relative to the first body engager, wherein movement along the body comprises:

a translational movement relative to the shooting axis; and a rotational movement causing the cord engager to move between the inward position and the outward position.

16. A method for constructing an archery cord manager, the method comprising:

structuring a first end so that the first end is configured to be coupled to an archery bow, wherein the archery bow comprises a draw cord moveable in a draw cord plane to launch a projectile along a shooting axis;

structuring a second end;

structuring a body so as to extend between the first and second ends; and structuring a cord engager so that, when the cord engager is engaged with a supplemental cord of the bow, the cord engager is configured to:

(a) move from an inward position to an outward position in response to the bow transitioning from a drawn condition to an undrawn condition, wherein: (i) in the drawn condition, the draw cord is retracted, thereby starting a drawn period; and (ii) in the undrawn condition, the draw cord is released, thereby starting an undrawn period; and (b) apply a variable lateral force to the supplemental cord in response to the bow transitioning from the drawn condition to the undrawn condition, wherein the variable lateral force results in a lower sum of lateral forces on the supplemental cord during the drawn period than during the undrawn period, wherein the variable lateral force and the sum of lateral forces act along axes that intersect with the draw cord plane.

17. The method of claim 16, further comprising structuring a body engager so that the body engager is configured to be moveably coupled to the body so as to move along a length of the body in response to the transition between the drawn and undrawn conditions.

18. The method of claim 16, comprising structuring the body so that the body is configured to pivot relative to the archery bow in response to one of the variable force or the sum of lateral forces.

19. The method of claim 16, comprising structuring the body so that the body is configured to rotate relative to the archery bow in response to one of the variable force or the sum of lateral forces.

20. The method of claim 16, comprising structuring the cord engager so that the cord engager is configured to rotate relative to the body in response to one of the variable force or the sum of lateral forces.

* * * * *